US007873179B2

(12) United States Patent
Takewa

(10) Patent No.: US 7,873,179 B2
(45) Date of Patent: Jan. 18, 2011

(54) SPEAKER

(75) Inventor: Hiroyuki Takewa, Osaka (JP)

(73) Assignee: Panasonic Corporation, Osaka (JP)

( * ) Notice: Subject to any disclaimer, the term of this patent is extended or adjusted under 35 U.S.C. 154(b) by 1070 days.

(21) Appl. No.: 11/629,312

(22) PCT Filed: Mar. 10, 2006

(86) PCT No.: PCT/JP2006/304768

§ 371 (c)(1),
(2), (4) Date: Dec. 13, 2006

(87) PCT Pub. No.: WO2006/098243

PCT Pub. Date: Sep. 21, 2006

(65) Prior Publication Data

US 2008/0273740 A1 Nov. 6, 2008

(30) Foreign Application Priority Data

Mar. 14, 2005 (JP) ..... 2005-070671

(51) Int. Cl.
*H04R 25/00* (2006.01)

(52) U.S. Cl. ..... 381/401; 381/400; 381/430

(58) Field of Classification Search ..... 381/399, 381/400, 401, 402, 406, 408, 430
See application file for complete search history.

(56) References Cited

U.S. PATENT DOCUMENTS 5,764,784 A 6/1998 Sato et al.
6,594,372 B2 7/2003 Nakaso

FOREIGN PATENT DOCUMENTS

| | | |
|---|---|---|
| JP | 59-111391 | 7/1984 |
| JP | 03-250896 | 11/1991 |
| JP | 10-290492 | 10/1998 |
| JP | 2001-211497 | 8/2001 |
| JP | 2003-032783 | 1/2003 |
| JP | 2003-47089 | 2/2003 |
| JP | 2003-102088 | 4/2003 |
| JP | 2003-284187 | 10/2003 |
| JP | 2004-180193 | 6/2004 |

*Primary Examiner*—Suhan Ni
(74) *Attorney, Agent, or Firm*—Wenderoth, Lind & Ponack, L.L.P.

(57) ABSTRACT

The speaker according to the present invention comprises: a magnetic circuit; a diaphragm, a part of which is located in a magnetic gap formed in the magnetic circuit; a ring-shaped first voice coil formed on a first vibrating surface of the diaphragm; a ring-shaped second voice coil which is formed on a second vibrating surface of the diaphragm, the second vibrating surface being an opposite surface to the first vibrating surface, and which is electrically conducted with the first voice coil; and an edge firmly fixed on an outer margin of the first vibrating surface and operable to support the diaphragm in such a manner that enables vibration. The first voice coil is formed so as to be located inside of an inner circumference of the edge and also within the magnetic gap. The second voice coil is formed so as to have at least a part of an outermost circumference thereof is located outside of the inner circumference of the edge and within the magnetic gap.

20 Claims, 15 Drawing Sheets

SPEAKER

TECHNICAL FIELD

The present invention relates to a speaker, more particularly to a compact thin speaker.

BACKGROUND ART

In recent years, a landscape TV screen is becoming popular due to diffusion of so-called high definition and wide vision TVs. However, on the other hand, in consideration of Japanese housing circumstances, a TV set which is narrow in width and thin as a whole is desired. As above described, although a TV screen is becoming long horizontally, the TV set which is narrow in width and thin as a whole TV is still desired, and thus a speaker unit (herein after referred to as speaker) to be mounted in the TV is required to be small and thin. Therefore, a speaker, which uses a copper foil pattern formed on a diaphragm as a voice coil, has been proposed (see, e.g. Patent Document 1).

Hereinafter, referring to FIG. 21, a conventional speaker will be described. FIG. 21 is a cross sectional view of the conventional speaker. The conventional speaker comprises a yoke 91, a magnet 92, a diaphragm 93, and a voice coil 94. The magnet 92 has a lower surface firmly fixed to a central portion of the yoke 91. In a space between the magnet 92 and the yoke 91, a magnetic gap 95 is formed. The diaphragm 93 is planate, and an extremity thereof is firmly fixed to the yoke 91. A central portion of the diaphragm 93 is firmly fixed to an upper surface of the magnet 92. The voice coil 94 comprises a copper foil pattern formed on an upper surface of the diaphragm 93, and is located on a whole surface of a part of the diaphragm 93, which is situated in the magnetic gap 95 (herein after referred to as vibrating portion).

Here, in the voice coil, a driving force is generated, in a vertical direction, by a motive current and magnetic flux within the magnetic gap 95. With the driving force, a vibrating portion of the diaphragm 93 vibrates vertically, and a sound is produced. In this way, the conventional speaker realizes downsizing with the copper foil pattern, which is formed on the upper surface of the diaphragm 93, used as the voice coil 94. Patent Document 1: Japanese Laid-Open Patent Publication No. 2001-211497

DISCLOSURE OF THE INVENTION

Problems to be Solved by the Invention

Here, in the above-described conventional speaker, the voice coil 94 is formed only on the upper surface of the vibrating portion of the diaphragm 93. Therefore, an elongation degree of the vibrating portion differs between the upper surface and a lower surface, which consequently results in deformation due to a change in a surrounding environment. There has been a problem that sound quality deteriorates due to the deformation. Further, in recent years, along with an enhancement in picture quality of a TV screen, an enhancement in the sound quality of a speaker is demanded. In this regard, it is difficult for the conventional speaker, which is accompanied by deterioration in the sound quality as above mentioned, to realize the enhancement in the sound quality recently requested.

Therefore an object of the present invention is to solve the above problems and to provide a compact thin speaker which realizes the enhancement in the sound quality.

Solution to the Problems

A first aspect of the present invention is directed to a speaker which comprises: a magnetic circuit; a diaphragm, a part of which is located in a magnetic gap formed in the magnetic circuit; a ring-shaped first voice coil formed on a first vibrating surface of the diaphragm; a ring-shaped second voice coil which is formed on a second vibrating surface of the diaphragm, the second vibrating surface being an opposite surface to the first vibrating surface, and which is electrically conducted with the first voice coil; and an edge firmly fixed on an outer margin of the first vibrating surface and operable to support the diaphragm in such a manner that enables vibration, wherein the first Voice coil is formed so as to be located inside of an inner circumference of the edge and also within the magnetic gap, and the second voice coil is formed so as to have at least a part of an outermost circumference thereof located outside of the inner circumference of the edge and also within the magnetic gap.

A second aspect of the present invention is the according to the above first aspect, wherein a node of a primary resonance mode of the diaphragm exists between an innermost circumference of the first voice coil and the outermost circumference of the second voice coil.

A third aspect of the present invention is the speaker according to the above second aspect, wherein a distance from a position of the node of the primary resonance mode to the innermost circumference of the first voice coil is same as the distance from the position of the node of the primary resonance mode to the outermost circumference of the second voice coil.

A fourth aspect of the present invention is the speaker according to the above second aspect, wherein the magnet circuit comprises a pillar-shaped magnet situated at a position facing the second vibrating surface, and that an extremity of a surface of the magnet, the surface facing the second vibrating surface, coincides with the position of the node of the primary resonance mode.

A fifth aspect of the present invention is the speaker according to the above second aspect, wherein the magnetic circuit comprises: a first pillar-shaped magnet located at a position facing the first vibrating surface; and a second pillar-shaped magnet located at a position facing the second vibrating surface, and the node of the primary resonance mode exists on a straight line connecting, by a most direct way, an extremity of a surface of the first magnet, the surface facing the first vibrating surface, with an extremity of a surface of the second magnet, the surface facing the second vibrating surface.

A sixth aspect of the present invention is the speaker according to the above first aspect, further comprising: a first leading line to input a driving current to the first voice coil; and a second leading line to input the driving current to the second voice coil, wherein the first and the second leading lines are located so as to be symmetrical with respect to a center of the diaphragm, a winding direction of the first voice coil is a same direction as the winding direction of the second voice coil with respect to the first vibrating surface, and a position of a gravity center of each of the first and second voice coils coincides with the center of the diaphragm.

A seventh aspect of the present invention is the speaker according to the above sixth aspect further comprising a weight added to the diaphragm such that the position of the gravity center of each of the first and the second voice coils coincides with the center of the diaphragm.

An eighth aspect of the present invention is the speaker according to the above seventh aspect, wherein the weight, having a same shape as a wiring constituting each of the first and the second voice coils has, is added so as to be aligned along the wiring of either of the first or the second voice coil.

A ninth aspect of the present invention is the speaker according to the above first aspect, wherein the diaphragm has an elongated shape, the first and the second voice coils have shapes, which are formed on the diaphragm, of elongated shapes including along side portion which is aligned along a long side direction of the diaphragm, and the second voice coil is formed such that at least the outermost circumference of the long side portion thereof is located outside of the inner circumference of the edge and within the magnetic gap.

A tenth aspect of the present invention is the speaker according to the above ninth aspect, wherein the node of the primary resonance mode of the diaphragm in a short side direction exists between an innermost circumference of the long side portion of the first voice coil and the outermost circumference of the long side portion of the second voice coil.

An eleventh aspect of the present invention is the speaker according to the above tenth aspect, wherein a distance from a position of the node of the primary resonance mode in the short side direction to the innermost circumference of the long side portion of the first voice coil is same as the distance from the position of the node of the primary resonance mode to the outermost circumference of the long side portion of the second voice coil.

A twelfth aspect of the present invention is the speaker according to the above tenth aspect, wherein the magnetic circuit comprises a pillar-shaped magnet being located at a position facing the second vibrating surface, and in the short side direction of the diaphragm, an extremity of a surface of the magnet, the surface facing the second vibrating surface, coincides with the position of the node of the primary resonance mode in the short side direction.

A thirteenth aspect of the present invention is the speaker according to the above tenth aspect, wherein the magnetic circuit comprises: a pillar-shaped first magnet located at a position facing the first vibrating surface; and a pillar-shaped second magnet located at a position facing the second vibrating surface, and in the short side direction of the diaphragm, the node of the primary resonance mode in the short direction exists on a straight line connecting, by a most direct way, an extremity of a surface of the first magnet, the surface facing the first vibrating surface, with an extremity of a surface of the second magnet, the surface facing the second vibrating surface.

A fourteenth aspect of the present invention is the speaker according to the above ninth aspect, further comprising: a first leading line to input a driving current to the first voice coil; and a second leading line to input the driving current to the second voice coil, wherein the first and the second leading lines are located so as to be symmetrical with respect to a center of the diaphragm, a winding direction of the first voice coil is a same direction as the winding direction of the second voice coil with respect to the first vibrating surface, and a position of a gravity center of each of the long side portions of the first and the second voice coils coincide with the center of the diaphragm.

A fifteenth aspect of the present invention is the speaker according to the above fourteenth aspect, further comprising a weight added to the diaphragm such that the position of the gravity center of each of the long side portions of the first and the second voice coils coincides with the center of the diaphragm.

A sixteenth aspect of the present invention is the speaker according to the above fifteenth aspect, wherein the weight, having a same shape as a wiring constituting each of the first and the second voice coils, is added so as to be aligned along the long side portion of either of the first or the second voice coil.

A seventeenth aspect of the present invention is the speaker according to the above first aspect, wherein an outermost circumference of the first voice coil is located outside of an innermost circumference of the second voice coil.

An eighteenth aspect of the present invention is the speaker according to the above first aspect, wherein the outermost circumference of the first voice coil adjoins the inner circumference of the edge.

A nineteenth aspect of the present invention is the speaker according to the above first aspect, wherein a shape of the edge is a roll shape.

A twentieth aspect of the present invention comprises the speaker according to the above first aspect and a housing for accommodating the speaker.

Effect of the Invention

According to the above-described first aspect, since the first and the second voice coils are formed on the both surfaces of the diaphragm, it is possible to prevent deformation of the diaphragm caused by a change in a surrounding environment. As a result, a compact thin speaker that has achieved high sound quality can be provided. Further, according to the present aspect, since a structure is such that the first voice coil is not sandwiched in between the edge and the diaphragm, it is possible to prevent an adhesion failure between the edge and the diaphragm, which is caused by the first voice coil being sandwiched in between the edge and the diaphragm.

According to the above-described second aspect, the driving force can be generated at the position of the node of the primary resonance mode, which prevents a peak/dip of a sound pressure frequency response arising from the primary resonance mode, and consequently a less distorted reproduced sound can be realized.

According to the above-described third aspect, a resultant force of the driving forces respectively generated in the first and second voice coils reaches its maximum at the position of the node of the primary resonance mode, and thus the primary resonance mode can be suppressed effectively.

According to the above-described forth aspect, a magnetic flux density reaches its maximum at the position of the node of the primary resonance mode, which increases driving forces generated in the first and second voice coils both of which are located at the position of the node of the primary resonance mode. As a result, a high efficiency speaker can be provided.

According to the above-described fifth aspect, since the magnetic flux density reaches its maximum at the position of the node of the primary resonance mode, and since there are two magnets, the driving forces to be generated in the first and second voice coils both of which are located at the position of the node of the primary resonance mode can enlarge compared to a case of only one magnet. As a result, an even higher efficiency speaker can be provided compared to the case of the only one magnet.

According to the above-described sixth to eighth aspects, an asymmetrical vibration of a diaphragm can be prevented, which consequently results in prevention of an occurrence of a distortion caused by the asymmetrical vibration.

According to the above-described ninth aspect, even if the diaphragm has the elongated shape, the compact thin speaker which realizes the high sound quality can be provided. Further, the sound quality can be even more improved with an occurrence of an abnormal sound and the distortion arising from the adhesive failure being suppressed.

According to the above-described tenth aspect, the node of the primary resonance mode in the short side direction of the diaphragm exists between the innermost circumference of the long side portion of the first voice coil and the outermost circumference of the long side portion of the second voice coil. Here, in the elongated diaphragm, the primary resonance mode in the short side direction of the diaphragm has a larger impact on deterioration in the sound quality than that in the long side direction has. Therefore, according to the present aspect, a driving force can be generated at the position of the node of the primary resonance mode in this short side direction, and thus the deterioration in the sound quality caused by the primary resonance mode can be prevented efficiently.

According to the above described eleventh aspect, a resultant force of the driving forces to be generated respectively in the long side portions of the first and second voice coils reaches its maximum at the position of the node of the primary resonance mode in the short side direction of the diaphragm, and thus the primary resonance mode can be suppressed effectively.

According to the above-described twelfth aspect, the magnetic flux density reaches its maximum at the position of the node of the primary resonance mode in the short side direction of the diaphragm, and thus the driving forces to be generated in the first and the second voice coils both of which are located at the position of the node of the primary resonance mode can be enlarged. As a result, a high efficiency speaker can be provided effectively.

According to the above-described thirteenth aspect, since the magnetic flux density reaches its maximum at the position of the node of the primary resonance mode in the short side direction of the diaphragm, and since there are two magnets, the driving forces to be generated in the first and the second voice coils, both of which are located at the position of the node of the primary resonance mode, can be enlarged compared to the case of only one magnet. As a result, an even higher efficiency speaker can be provided compared to the case of only one magnet.

According to the above-described fourteenth to sixteenth aspects, the asymmetrical vibration in the short side direction of the diaphragm can be suppressed, and consequently an occurrence of the distortion caused by the asymmetrical vibration can be suppressed effectively.

According to the above-described seventeenth aspect, the first and the second voice coils are located in a vibrating direction of the diaphragm in an overlapped manner, and thus the first and the second voice coils can be driven integratedly.

According to the above-described eighteenth aspect, first and second voice coils are located in an adjoining manner, and thus the first and the second voice coils can be driven integratedly.

According to the above-described nineteenth aspect, amplitude of the diaphragm becomes amplitude having good linearity, which can suppress the distortion generated by non-linearization of the amplitude.

DESCRIPTION OF THE REFERENCE CHARACTERS

Figure 1:
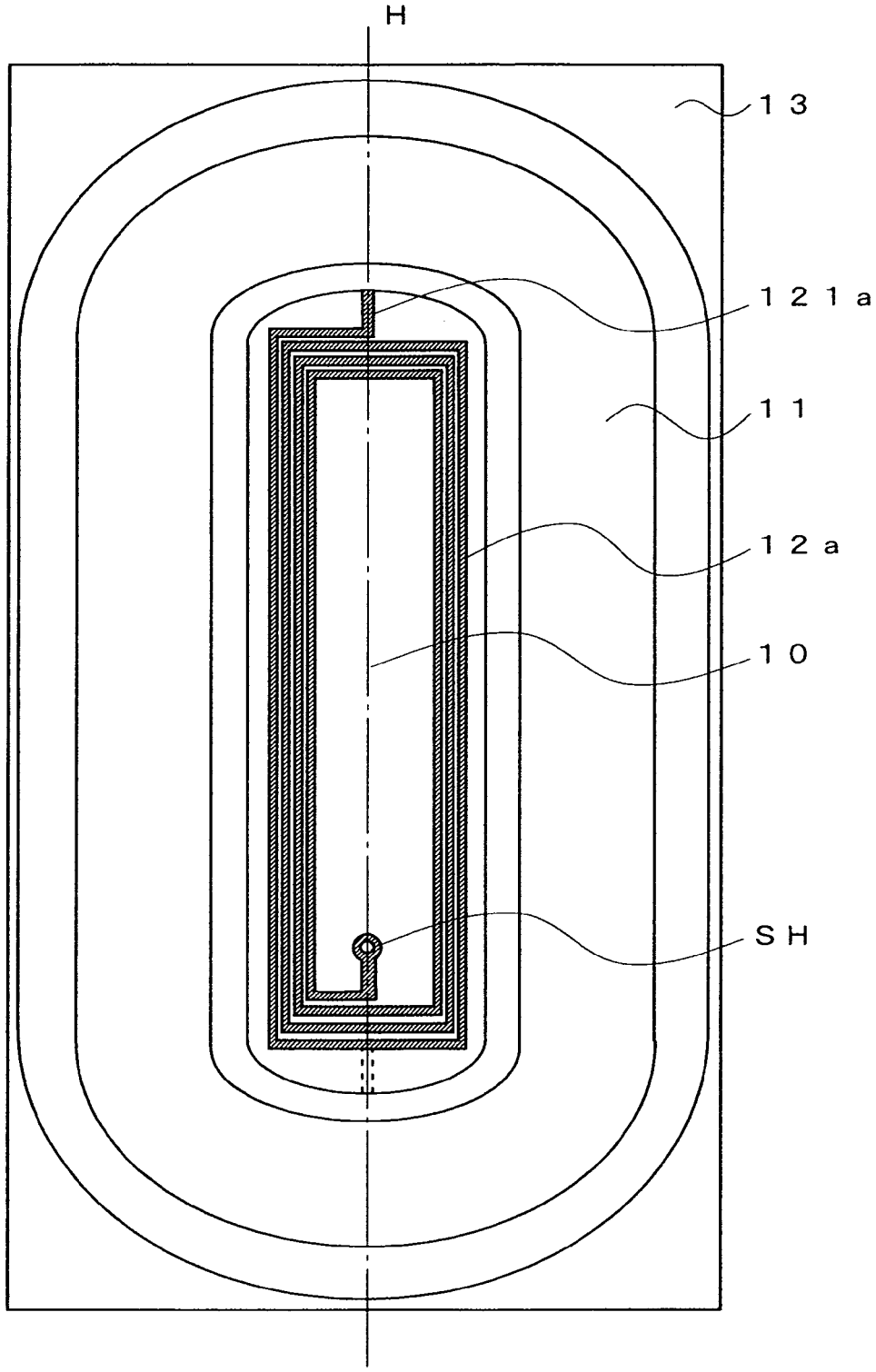
FIG. 1 is a plan view of a speaker according to a first embodiment.

10 diaphragm
11 edge
12 voice coil
12*a* upper surface coil
12*b* lower surface coil
13 frame
14 yoke
15, 25 magnet
50 additional wiring
60 display screen

61 speaker
101 terminal
102 leading line
121 lead wire portion

BEST MODE FOR CARRYING OUT THE INVENTION

First Embodiment

Figure 2:
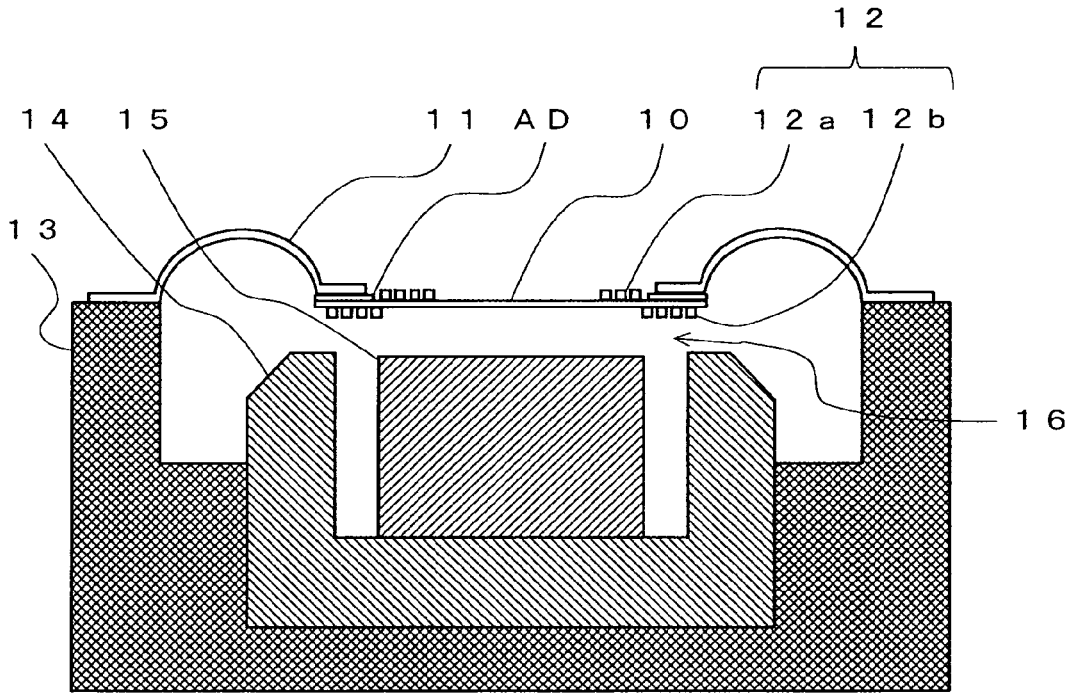
FIG. 2 is across sectional view of the speaker, shown in FIG. 1, in a short side direction.

A speaker according to a first embodiment of the present invention will be described, referring to FIGS. 1 and 2. FIG. 1 is a plan view of the speaker according to the first embodiment of the present invention. FIG. 2 is a cross sectional view of the speaker, shown in FIG. 1, in a short side direction. In below description, as an example, such an elongated speaker as shown in FIG. 1 will be described. In addition, as an example, a shape of a diaphragm is set as a racetrack shape (herein after referred to as track shape), where two opposite sides of a rectangle are replaced with half circles.

As shown in FIG. 2, the speaker according to the present embodiment comprises a diaphragm 10, an edge 11, a voice coil 12, a frame 13, a yoke 14, and a magnet 15.

The diaphragm 10 is made of a high-polymer material (high-polymer film), etc., including polyimide, epoxy or the like. A shape of the diaphragm 10 is a track shape. Further, a shape of the diaphragm 10 on a cross section is an approximate plane. By making the shape of the cross section the approximate plane, thinning of the whole speaker can be enhanced.

The edge 11 is a component which supports the diaphragm 10 in such a manner that enables vibration. Specifically, an inner margin of the edge 11 is firmly fixed to an outer margin of an upper surface of the diaphragm 10 with an adhesive agent AD. An outer margin of the edge 11 is firmly fixed to the frame 13. Accordingly, the edge 11 supports the diaphragm 10 in the manner that enables vibration in a vertical direction. Also, a cross-sectional shape of the edge 11 is a roll shape. Because of the cross-sectional shape of the edge 11 formed in a roll shape, an amplitude, having good linearity, of the diaphragm 10 may be ensured. The roll shape is not limited to a half circle shape, but can be any shape that ensures the amplitude having good linearity. Therefore, the roll shape may be, for example, a half elliptical shape which is made by halving an ellipse.

The voice coil 12 is a so-called print coil which is made by patterning of a conductor such as copper foil. The voice coil 12 is formed, in a ring shape, on both upper and lower sides of the diaphragm 10. In the present embodiment, as shown in FIG. 1, the voice coil 12 is formed in a rectangle. Here, the voice coil 12 formed on an upper surface of the diaphragm 10 is referred to as an upper surface coil 12*a*. Further, the voice coil 12 formed on a lower surface of the diaphragm 10 is referred to as a lower surface coil 12*b*. The upper surface coil 12*a* and the lower surface coil 12*b* are connected to each other at a through hole SH, and are conducting electrically. A forming method and a locating position of the voice coil 12 will be described herein below specifically.

The frame 13 is a rectangular housing. As shown in FIG. 2, an opening portion is formed on an upper surface of the frame 13. The yoke 14 is a rectangular housing, and an outer shape thereof is smaller than that of the frame 13. On an upper surface of the yoke 14, an opening portion is formed as shown in FIG. 2. The yoke 14 is, having a bottom portion thereof firmly fixed on an interior base surface of the frame 13, placed on an inner side of the housing of the frame 13. The magnet 15 is a pillar-shaped (e.g. rectangular parallelepiped) magnet. The magnet 15 is, having a lower surface thereof firmly fixed on an interior base surface of the yoke 14, placed on an inner side of a housing of the frame 14. With the yoke 14 and the magnet 15, the magnetic gap 16 is formed between upper surfaces of the yoke 14 and the magnet 15 and the lower surface of the diaphragm 10. As above described, the yoke 14 and the magnet 15 constitute, at positions of the upper surface coil 12*a* and the lower surface coil 12*b*, a magnetic circuit which forms the magnetic gap 16. At each of the upper surface coil 12*a* and the lower surface coil 12*b*, a driving force is generated in a vertical direction by a magnetic flux in the magnetic gap 16 and a driving current. With the driving force, the diaphragm 10 vibrates vertically, and then sound is produced.

Here, the above-described forming method of the voice coil 12 will be specifically described. With regard to the forming method, various methods are generally known. In the present embodiment, the generally known method may be used, however, it is preferable to apply a method called a semi-additive method. According to the method, a high-polymer film (12.5 to 50 microns in thickness), corresponding to the diaphragm 10, is used as a base material, and thin copper foil is formed on upper and lower surfaces of the base material by vapor deposition.

Then, electroplating is conducted until a thickness of the evaporated copper foil becomes two to eight microns. Next, a hole piercing through the upper and lower surfaces of the base material is made at a position where the through hole SH should be formed. And then, a photo-resist layer is formed on each of the upper and lower surfaces. After formation of the photo-resist layers, exposure processing is conducted by covering with masks for shielding pattern portions of the upper surface coil 12*a* and the lower surface coil 12*b*. After the exposure processing, an unexposed photo-resist layer is removed. At this time, the pattern portions of the upper surface coil 12*a* and the lower surface coil 12*b* are barely formed. On the other hand, portions other than the pattern portions of the upper surface coil 12*a* and the lower surface coil 12*b* are covered with the resist layers. The barely-formed pattern portions of the upper surface coil 12*a* and the lower surface coil 12*b* are electroplated until the pattern portions become a predetermined thickness (typically about 40 microns). At this time, plating is extended to the hole passing through between the upper and the lower surfaces, and the respective copper foils on the upper and lower surfaces are connected with each other. That is, a through hole, conducting electricity between the upper surface coil 12*a* and the lower surface coil 12*b*, is formed.

Then, with respect to the upper and the lower surfaces, the remaining resist layers are removed, and the whole surfaces are etched. With the etching, the thin copper foils evaporated on the base material are removed prior to the upper surface coil 12*a* and the lower surface coil 12*b*. And then, the copper foil only at the pattern portions of the upper surface coil 12*a* and the lower surface coil 12*b* and at the through hole portion remains on the base material. As above described, the upper surface coil 12*a* is formed on the upper surface of the diaphragm 10, and the lower surface coil 12*b*, conducting electricity through the through hole SH to the upper surface coil 12*a*, is formed on the lower surface of the diaphragm 10. This is the end of the description of the formation of the voice coil 12.

Figure 3:
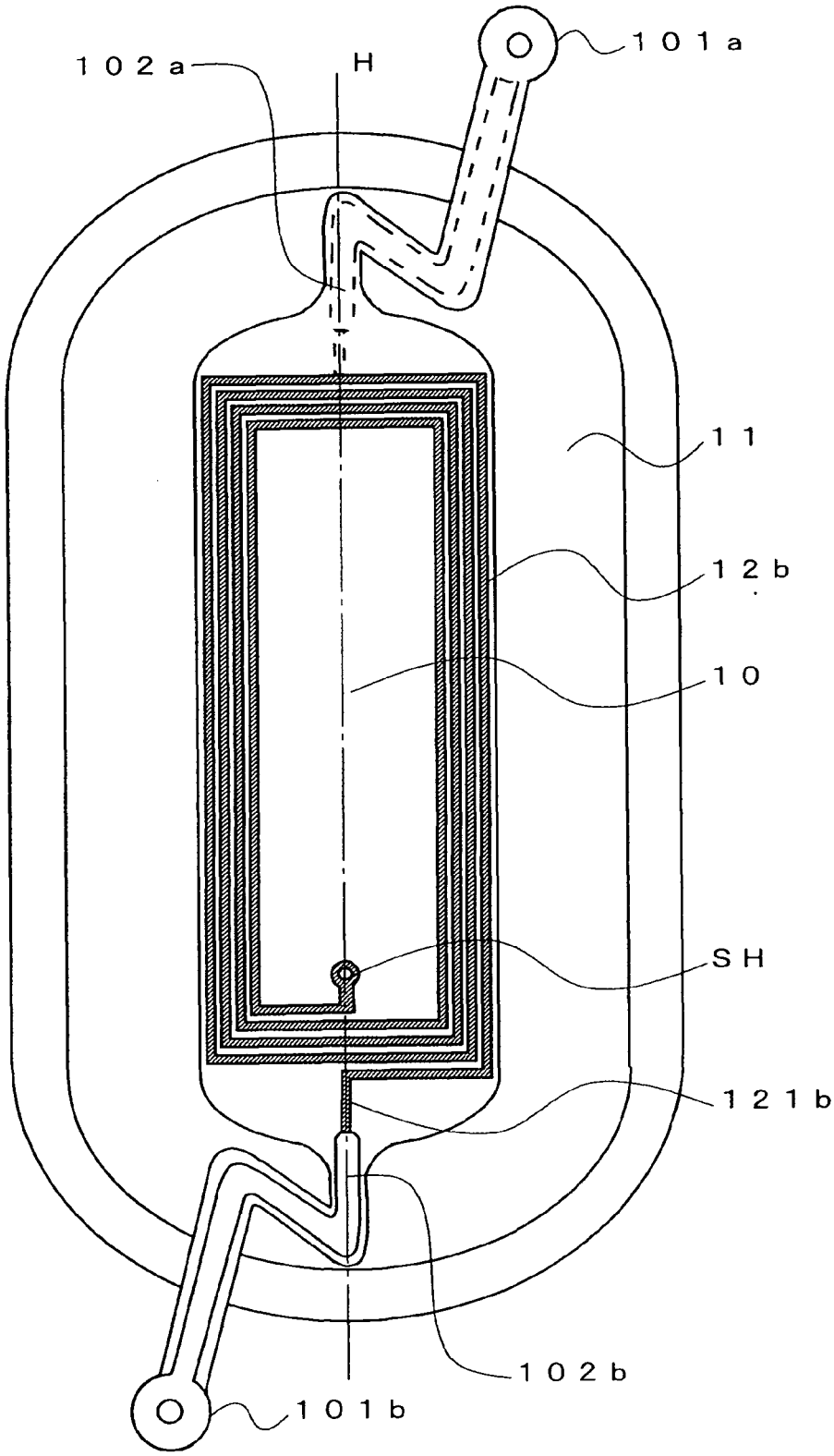
FIG. 3 is a diagram illustrating an appearance on a lower surface side of a diaphragm 10, an edge 11, and a voice coil 12, all of which are shown in FIG. 1.

Next, referring to FIGS. 1 and 3, a driving current passing through the upper surface coil 12*a* and the lower surface coil 12*b* will be described. FIG. 3 is a diagram illustrating an appearance on a lower surface side of the diaphragm 10, the edge 12, and the voice coil 12, all of which are shown in FIG. 1.

Referring to FIG. 3, a driving current inputted from one of two input terminals (not shown), which are provided to the frame 13, is inputted to a terminal 101*a* formed in the diaphragm 10. The terminal 101*a* is firmly fixed to the input terminal provided to the frame 13 and conducts electricity through to the upper surface coil 12*a* via a leading line 102*a*. A lead wire portion 121*a* of the upper surface coil 12*a* is located on a centerline H of the diaphragm 10, and connected to the leading line 102*a*. The driving current inputted to the terminal 101*a* passes through the upper surface coil 12*a* shown in FIG. 1, and reaches the through hole SH. The through hole SH is located on the centerline H of the diaphragm 10, and connected to the lower surface coil 12*b*. Accordingly, the driving current passing through the upper surface coil 12*a* passes through the lower surface coil 12*b* via the through hole SH. The lead wire portion 121*b* of the lower surface coil 12*b* is located on the centerline H of the diaphragm 10, and connected to a leading line 102*b*. Accordingly, as shown in FIG. 3, the driving current passing through the lower surface coil 12*b* is inputted to a terminal 101*b* formed on the diaphragm 10 via the leading line 102*b*. The terminal 101*b* is firmly fixed on the other input terminal provided to the frame 13.

As above described, the driving current passing through the upper surface coils 12*a* passes in the same direction as that passing through the lower surface coils 12*b* when being looked from one side, either an upper surface side or a lower surface side. That is, a winding direction of the upper surface coil 12*a* is the same direction as that of the lower surface coil 12*b* when being looked from one surface side, either the upper surface side or the lower surface side of the diaphragm 10. As a result, at the upper surface coil 12*a* and the lower surface coil 12*b*, the driving forces in the same directions are generated by the driving current and the magnetic flux in the magnetic gap 16.

Figure 4:
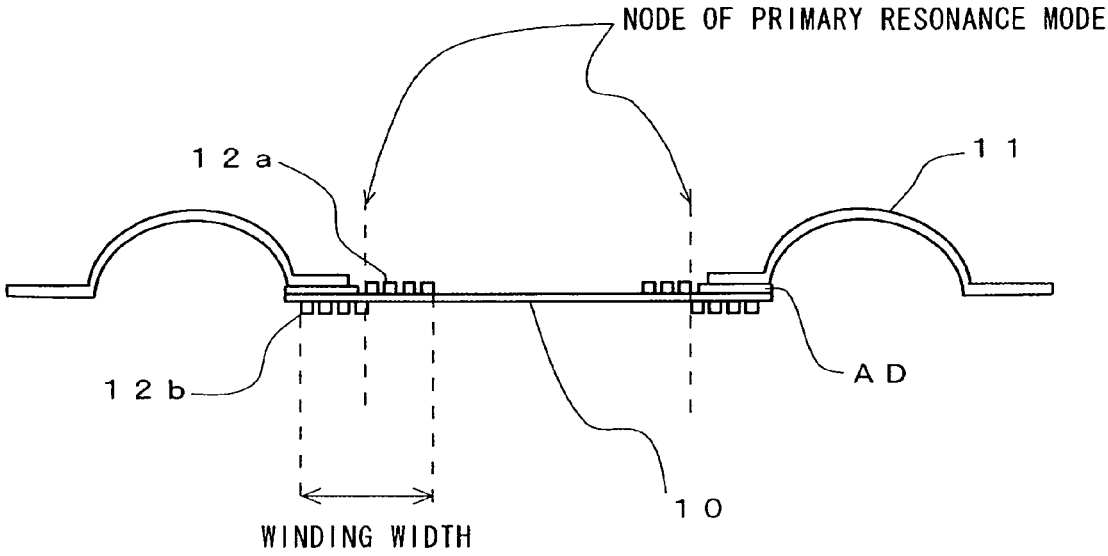
FIG. 4 is across-sectional view of the diaphragm 10, the edge 11, and the voice coil 12 in the short side direction.

Next, referring to the FIG. 4, locating positions of the upper surface coil 12*a* and the lower surface coil 12*b* will be described. FIG. 4 is a cross sectional view of the diaphragm 10, the edge 11, and the voice coil 12, in the short side direction.

As shown in FIG. 4, a long side portion of the upper surface coil 12*a* is located on the upper surface of the diaphragm 10. Further, the upper surface coil 12*a* is located inside of the inner circumference of the edge 11. On the other hand, alongside portion of the lower surface coil 12*b* is located on the lower surface of the diaphragm 10. An outermost circumference of the long side portion of the lower surface coil 12*b* is located outside of the inner circumference of the edge 11. In the case of FIG. 4, a node of a primary resonance mode in the short side direction of the diaphragm 10 exists within a winding width between an innermost circumference of the long side portion of the upper surface coil 12*a* and the outermost circumference of the long side portion of the lower surface coil 12*b*. The primary resonance mode will be specifically described herein below. As illustrated in FIGS. 1 and 3, a short side portion of the upper surface coil 12*a* is located inside of the inner circumference of the edge 11, and is located at the same position as that of the lower surface coil 12*b*, which is also located inside of the inner circumference of the edge 11, with respect to the upper and lower surfaces of the diaphragm 10. That is, the short side portions of the upper surface coil 12*a* and the lower surface coil 12*b* are located in a vertically overlapped manner with the diaphragm 10 sandwiched in between.

Here, splitting resonance occurs on the diaphragm 10 at the time of vibration. Due to the splitting resonance, a peak/dip occurs on a sound pressure frequency characteristic of the speaker, which leads to a problem of deterioration in sound quality. The problem particularly occurs in the diaphragm 10 of an approximate plane shape. Further, of the splitting resonance, the primary resonance mode (here, such a mode, a number of nodes of which, contributing to the sound pressure frequency characteristic, is even-numbered is taken into account, and the order is referred to as 1, 2, and 3.) particularly affects the sound quality to a large extent. The nodes of the primary resonance mode tend to be located in the vicinity of extremities of a long side direction and a short side direction of the diaphragm 10.

First, the primary resonance mode in the long side direction of the diaphragm 10 will be considered. The long side portions of the upper surface coil 12*a* and the lower surface coil 12*b* are situated on an entire length of the diaphragm 10 in the long side direction as shown in FIGS. 1 and 3. That is, since the long side portions of the upper surface coil 12*a* and the lower surface coil 12*b* are long enough, an entire surface of the diaphragm 10 can be driven in the long side direction. And due to driving of the entire surface of the diaphragm 10, the primary resonance mode of the diaphragm 10 in the long side direction can be suppressed.

On the other hand, in the short side direction of the diaphragm 10, since lengths of the short side portions of the upper surface coil 12*a* and the lower surface coil 12*b* are short, a frequency of the primary resonance mode in the short side direction becomes extremely high. Thus, by suppressing the primary resonance mode in the short side direction, the deterioration in the sound quality caused by the primary resonance mode can be suppressed in a broad band range through to a frequency of a second resonance mode occurring subsequently. Here, to enhance a further improvement in the sound quality by suppressing the primary resonance mode in the short side direction, a method where the voice coil 12 is located on the nodes of or in the vicinity of the nodes of the primary resonance mode can be considered. By having the voice coil 12 located on the nodes of or in the vicinity of the nodes of the primary resonance mode, the driving force is generated on the nodes of or in the vicinity of the nodes of the primary resonance mode, and consequently the sound quality caused by the primary resonance mode can be suppressed.

Figure 5:
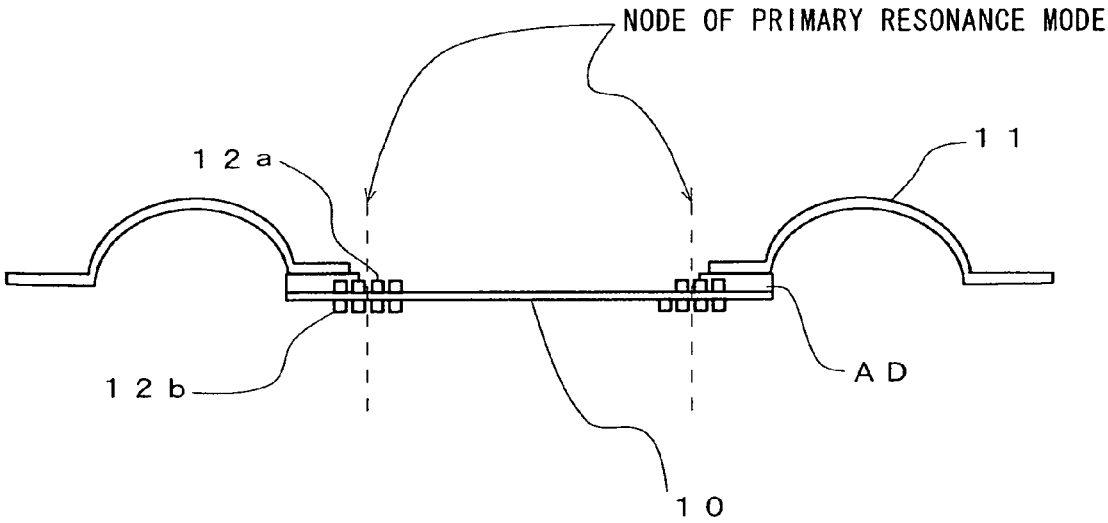
FIG. 5 is a diagram illustrating an example where long side portions of an upper surface coil 12*a* and a lower surface coil 12*b* are located respectively at a position of a node of a primary resonance mode in the short side direction.

Here, positions of the nodes of the primary resonance mode in the short direction of the diaphragm 10 are located near an outer circumference of the diaphragm 10 (inside of an extremity thereof), in the case of FIG. 4, for example. When explaining with numeric examples, assuming that a length of a short side of the diaphragm 10 is 1, the nodes of the primary resonance mode are likely to exist at positions corresponding to around 0.224 and a position corresponding to around 0.776 respectively, from an extremity of the short side of the diaphragm 10, for example. Therefore, in the case of FIG. 4, simply locating each of the long side portions of the upper surface coil 12*a* and the lower surface coil 12*b* at the positions of the nodes of the primary resonance mode is such as shown in FIG. 5. However, this case has a problem.

FIG. 5 is a diagram illustrating an example where the long side portions of the upper surface coil 12*a* and a lower surface coil 12*b* are located respectively at an identical position, that is, the positions of the nodes of primary resonance mode in the short side direction.

As illustrated in FIG. 5, in the case where each of the long side portions of the upper surface coil 12*a* and the lower surface coil 12*b* is located on the positions of the nodes of the primary resonance mode in the short side direction, a structure will become such that the upper surface coil 12*a* is trapped in an adhering portion between the edge 11 and the diaphragm 10. Here, the upper surface coil 12*a* generates heat due to passage of the driving current. Accordingly, due to the heat generation of the upper surface coil 12*a*, the adhesive agent AD becomes carbonized or softened, which leads to a problem of an occurrence of an adhesion failure. Furthermore, since the upper surface coil 12*a* is a copper foil pattern, unevenness is created on the upper surface coil 12*a*. Such unevenness will cause a problem that adhesion strength between the edge 11 and the diaphragm 10 becomes weak compared to a case of evenness.

As above described, if the long side portions of the upper surface coil 12*a* and the lower surface coil 12*b* are simply located at the positions of the nodes of the primary resonance mode, the diaphragm 10 and the edge 11 will separate from each other due to the adhesion failure, which may lead to an problem of an occurrence of abnormal noise or distortion during operation.

However, the present embodiment, as shown in FIG. 4, adopts a structure where the upper surface coil 12*a* is located inside of the inner circumference of the edge 11 such that the upper surface coil 12*a* is not sandwiched in between the edge 11 and the diaphragm 10. That is, it is the structure, where the upper surface coil 12*a* is located inside of the inner circumference of the edge 11, and the lower surface coil 12*b* is located such that the outermost circumference thereof is on a portion outside of the inner circumference of the edge 11. Accordingly, a driving force can be generated at the positions of the nodes of the primary resonance mode in the short side direction of the diaphragm 10 without causing the adhesion failure between the edge 11 and the diaphragm 10.

As above described, by locating the upper surface coil 12*a* inside of the inner circumference of the edge 11, and also by locating the lower surface coil 12*b* such that the outermost circumference thereof is on the portion outside of the inner circumference of the edge 11, it is possible to avoid the adhesion failure between the diaphragm 10 and the edge 11 and also to avoid the deterioration in the sound quality caused by the primary resonance mode in the short side direction of the diaphragm 10.

Figure 6:
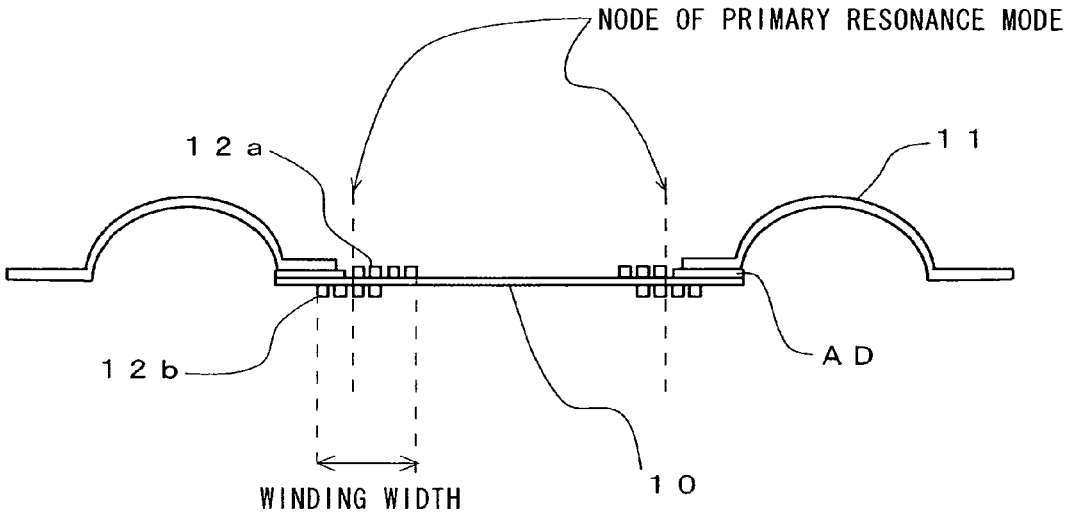
FIG. 6 is a diagram illustrating an example where the upper surface coil 12*a* and the lower surface coil 12*b* are located such that wirings thereof are partially overlapped in a vertical direction.

Note that the long side portions of the upper surface coil 12*a* and the lower surface coil 12*b* may be located such that wirings thereof are partially overlapped in a vertical direction, as illustrated in FIG. 6. FIG. 6 is a diagram illustrating an example where the upper surface coil 12*a* and the lower surface coil 12*b* are located such that the wirings thereof are partially overlapped in the vertical direction. Referring to FIG. 6, the nodes of the primary resonance mode in the short side direction of the diaphragm 10 are located within the winding widths of the upper surface coil 12*a* and the lower surface coil 12*b*, and the driving force is generated at the positions of the nodes. Here, when misalignment amounts between the upper surface coil 12*a* and the lower surface coil 12*b* are compared between FIGS. 4 and 6, the misalignment amounts shown in FIG. 6 are smaller. Here, the smaller the misalignment amounts are, the more integrally the upper surface coil 12*a* and the lower surface coil 12*b* can drive in the case where a magnetic flux density is constant, and consequently the driving force is focused on each positions of the nodes, which is preferable in term of the sound quality. To minimize the misalignment amounts, since the outermost circumference of the lower surface coil 12*b* is located on the portion outside of the inner circumference of the edge 11, the upper surface coil 12*a* is located as closest to the inner circumference of the edge 11 as possible. Each of the positions of the nodes itself may change depending on a misalignment of the edge 11 or a variation in weight of the adhesive agent AD. Therefore, as above described, although the smaller misalignment amount is more preferable, by having the upper surface coil 12*a* and the lower surface coil 12*b* located without setting the misalignment amounts to zero, the driving force can be generated, even if the positions of the nodes have changed, at the positions of the nodes after such change. That is, even if the misalignment amounts of the upper surface coil 12*a* and the lower surface coil 12*b* are the smallest, by having the upper surface coil 12*a* and the lower surface coil 12*b* located in a misaligned manner, it is possible to respond to a change in the positions of the nodes, the change which is caused by the misalignment of the edge or the variation in the weight of the adhesive agent AD.

Figure 7:
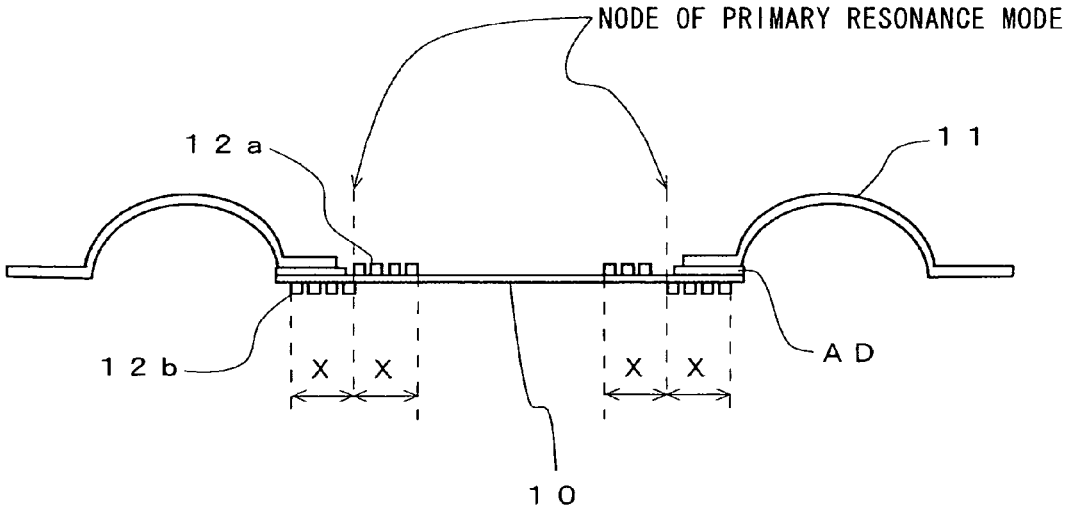
FIG. 7 is a diagram illustrating a situation where the long side portion of the upper surface coil 12*a* and the long side portion of the lower surface coil 12*b* are misaligned in equal amounts of X.

Further, apart from the locating position shown in the above-described FIGS. 4 and 6, by having the position of the node of the primary resonance mode in the short side direction set as a center, the long side portions of the upper surface coil 12*a* and the lower surface coil 12*b* may be located at positions misaligned from the center in equal amounts. FIG. 7 is a diagram illustrating a situation where the long side portion of the upper surface coil 12*a* and the long side portion of the lower surface coil 12*b* are misaligned in equal amounts of X. In the case where the long side portions of the upper surface coil 12*a* and the lower surface coil 12*b* are located in such a positional relationship as illustrated in FIG. 7, a resultant force of the drive forces respectively generated on the upper surface coil 12*a* and the lower surface coil 12*b* reaches its maximum at each of the positions of the nodes of the primary resonance mode in the short side direction. As a result, compared to the cases shown in FIGS. 4 and 6, the primary resonance mode in the short side direction can be suppressed effectively.

Figure 8:
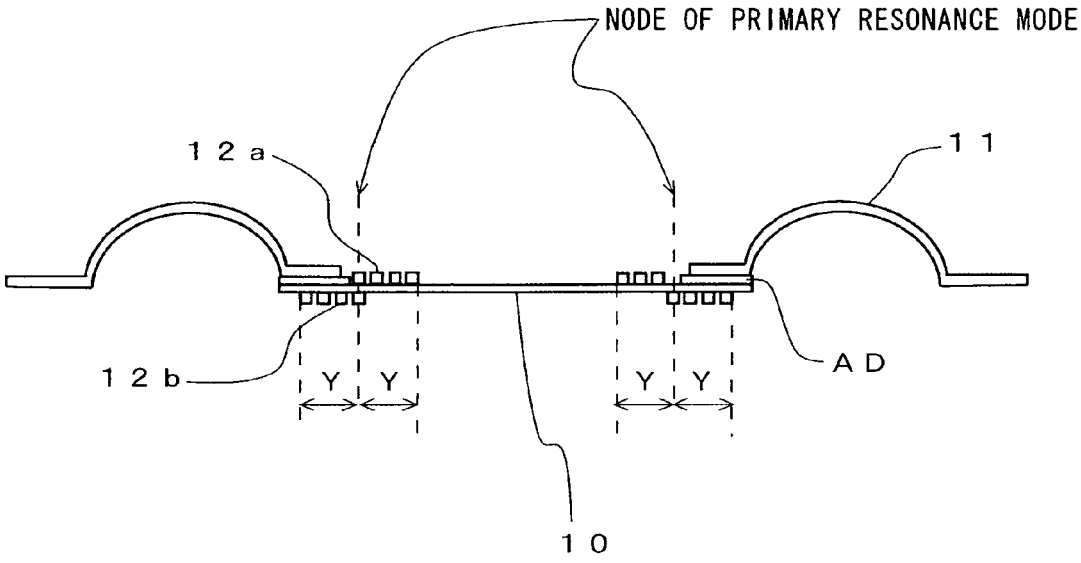
FIG. 8 is a diagram illustrating an example where the long side portions of the upper surface coil 12*a* and the lower surface coil 12*b* are located in a misaligned manner in amounts different from a misalignment amount X in FIG. 7.
Figure 9:
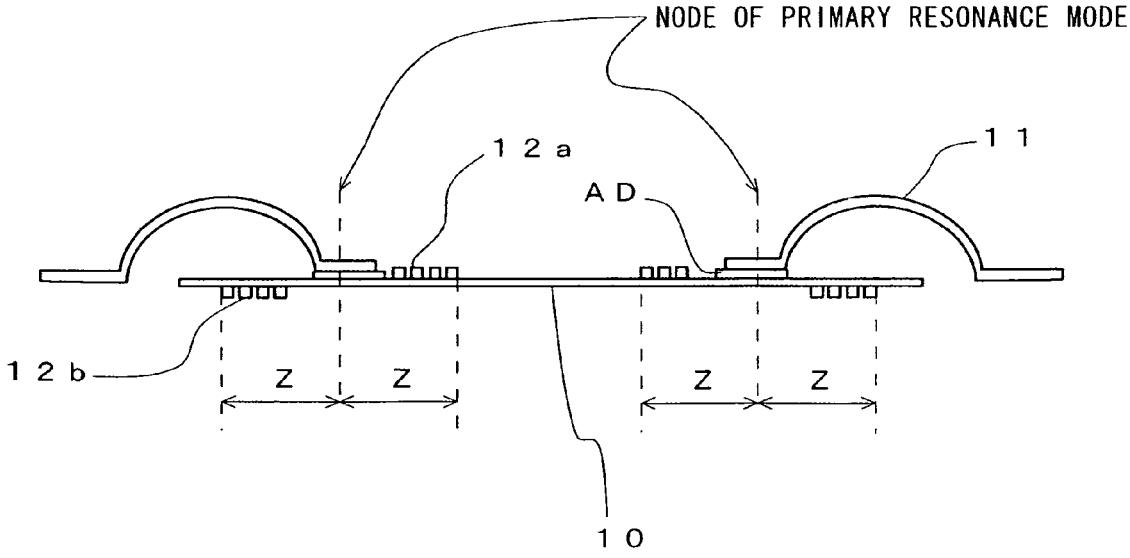
FIG. 9 is a diagram illustrating an example where the long side portions of the upper surface coil 12*a* and the lower surface coil 12*b* are located in a misaligned manner in amounts different from the misalignment amount X in FIG. 7.

Further, the long side portions of the upper surface coil 12*a* and the lower surface coil 12*b* may be located in a misaligned manner in such amounts as shown in FIGS. 8 and 9. FIGS. 8 and 9 are diagrams illustrating examples where long side portions of the upper surface coil 12*a* and the lower surface coil 12*b* are located in a misaligned manner in amounts different from the misalignment amount X in FIG. 7. FIG. 8 shows an example where each of the long side portions of the upper surface coil 12*a* and the lower surface coil 12*b* is located in a misalignment amount Y which is smaller than the misalignment amount X ($Y<X$). That is, the long side portions of the upper surface coil 12*a* and the lower surface coil 12*b* are located such that parts of the coils are overlapped in a vertical direction. FIG. 9 illustrates an example where each of the long side portions of the upper surface coil 12*a* and the lower surface coil 12*b* are located in a misalignment amount Z which is larger than the misalignment amount X ($Z>X$). As above described, the smaller misalignment amount is preferable.

The above description has described an example where the nodes of the primary resonance mode are located within the wiring widths between the innermost circumference of the upper surface coil 12*a* and the outermost circumference of the lower surface coil 12*b*. In contrast, even if the nodes of the primary resonance mode are located on portions outside of the winding widths, as far as being located in the vicinity of the winding widths, the driving force can be generated in the vicinity of the nodes of the primary resonance mode, which enables suppression of the deterioration in the sound quality.

Figure 10:
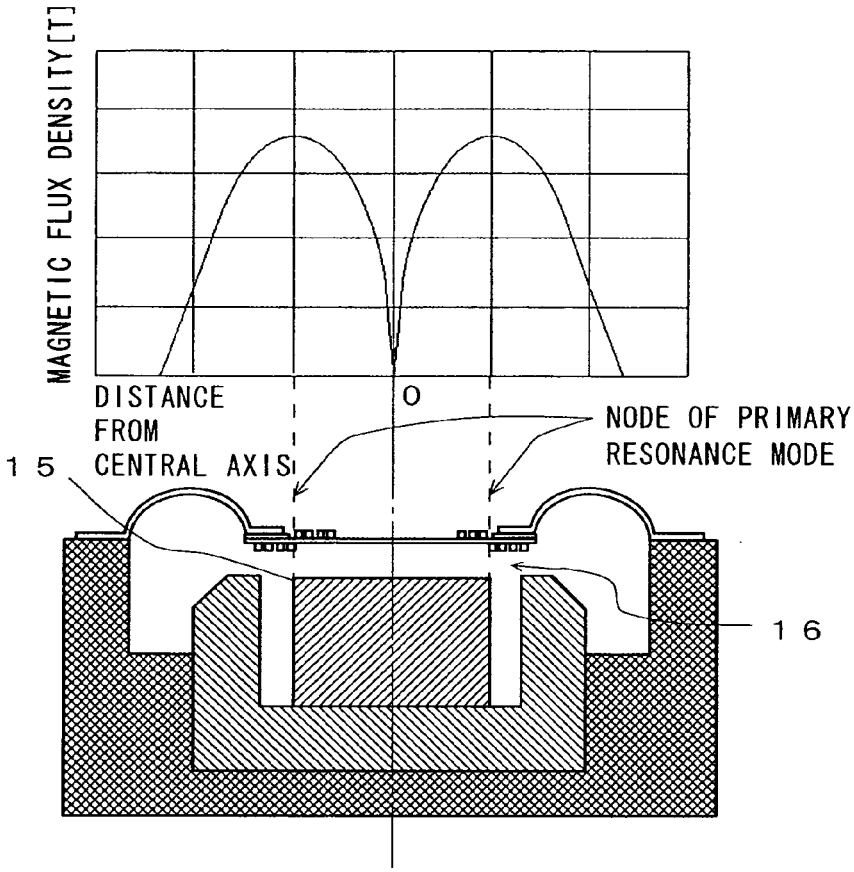
FIG. 10 is a diagram illustrating a cross-sectional drawing of the speaker in the short side direction according to the present embodiment, and showing a distribution chart of a magnetic flux density in a magnetic gap 16 formed under a lower surface of the diaphragm 10.

In the above description, although a positional relationship between the magnetic circuit comprising the yoke 14 and the magnet 15, and the voice coil 12 has not been specifically described, a high efficiency speaker is achievable in accordance with a location in a positional relationship below described. Referring to FIG. 10, the positional relationship to achieve a high efficiency speaker will be described specifically. FIG. 10 is a diagram illustrating a cross-sectional drawing of the speaker in the short side direction according to the present embodiment, and a distribution of the magnetic flux density in the magnetic gap 16 formed on the lower surface of the diaphragm 10. In the magnetic flux density distribution shown in FIG. 10, a horizontal axis has a central axis of the speaker cross-section set as zero, and indicates a position proceeding from the central axis toward an extremity of the diaphragm 10. Further, a vertical axis indicates a density of magnetic flux in the horizontal direction formed at a position on the horizontal axis. Here, the magnetic flux density is limited in the horizontal direction, since the magnetic flux in the horizontal direction causes the driving force in the voice coil 12. Further, in the distribution of the magnetic flux density shown in FIG. 10, the magnetic flux density is indicated by an absolute value. This is because the magnetic flux density becomes zero at the central axis of the speaker cross-section, and the polarity of the magnetic flux density inverts on reaching the central axis as boundary. Here, as is obvious from the distribution of the magnetic flux density shown in FIG. 10, the magnetic flux density increases as a position is moving from the central axis toward the extremity of the speaker, and reaches its maximum at the extremity of the magnet 15. Therefore, the positions of the nodes of the primary resonance mode in the short side direction are designed to be located immediately above the extremity of the magnet 15. Here, the positions of the nodes of the primary resonance mode may be changeable depending on the diaphragm 10, the edge 11, and the voice coil 12. Further, a size and a locating position of the magnet 15 may be changed such that the extremity of the magnet 15 are located at the positions of the nodes of the primary resonance mode. Accordingly, the magnetic flux density is set to reach its maximum at the positions of the nodes of the primary resonance mode, whereby the driving force generated in the voice coil 12 reaches its maximum, since the voice coil 12 is located, as described above, on the positions of the nodes of the primary resonance mode. As a result, the deterioration in the sound quality caused by the primary resonance mode can be suppressed and a high efficiency speaker can be achieved.

Figure 11:
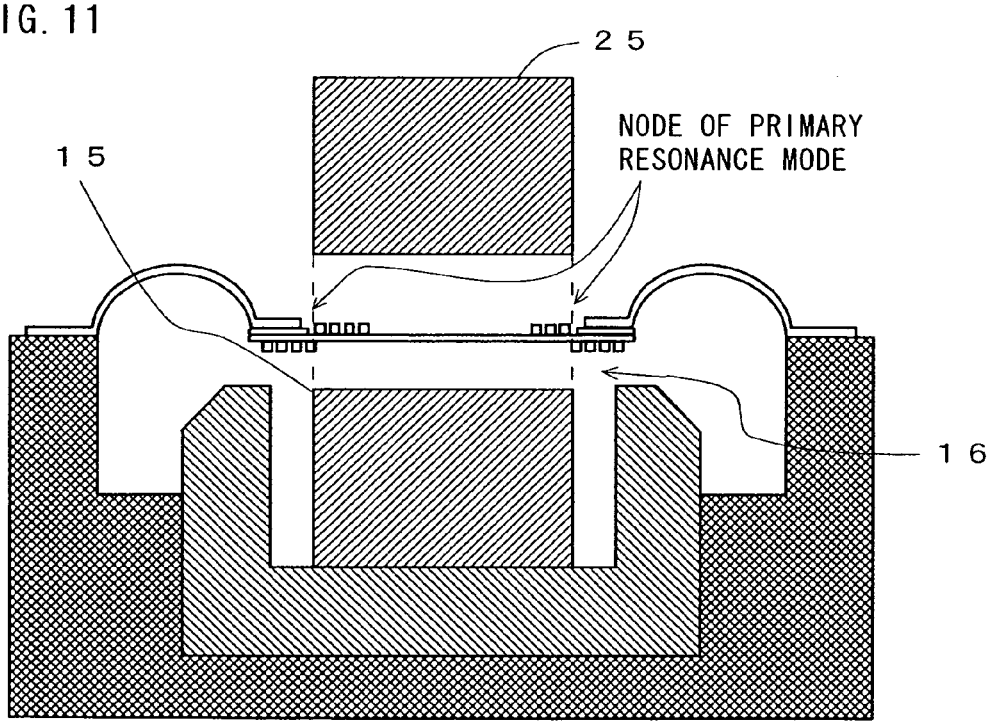
FIG. 11 is a diagram illustrating an example where a magnet 25 is located at an upper portion of a magnet 15 via the diaphragm 10.

Further, as shown in FIG. 11, in the case where a plurality of magnets 15 exist, if the magnetic flux density is set to reach its the maximum at the positions of the nodes of the primary resonance mode, a high efficiency speaker is achievable. FIG. 11 is a diagram illustrating an example where a magnet 25 is located at an upper side of the magnet 15 via the diaphragm 10. Referring to FIG. 11, the magnet 25 has the same shape as the magnet 15 has. Besides, the magnet 25 is located at the upper side of the magnet 15. The central axis of the magnet 25 coincides with the central axis of the magnet 15. Space is formed between the magnet 15 and the magnet 25, and the diaphragm 10 is located within the space. The magnets 15 and 25 are magnetized such that the respective facing surfaces have identical polarity. That is, the polar character of the upper surface of the magnet 15 is the same as the polar character of the lower surface of the magnet 25. As a result, magnetic flux in the horizontal direction increases, and the driving force increases compared to a case of the magnet 15 only. The maximum magnetic flux point is on each of dotted lines connecting the respective extremities of the magnets 15 and 25. Therefore, according to the example shown in FIG. 11, the positions of the nodes of the primary resonance mode in the short side direction are located on the dotted lines, whereby the driving force generated in the voice coil 12 reaches its maximum, and then a high efficiency speaker than that shown in FIG. 10 can be achieved.

A size of the magnet 25 may be different from that of the magnet 15.

According to the present embodiment above described, the voice coil 12 comprises the upper surface coil 12*a* and the lower surface coil 12*b*, and formed on the both surfaces of the diaphragm 10. Accordingly, elongation percentages of the upper surface and the lower surface of the diaphragm can be equalized, and a distortion due to a change in the surrounding environment can be prevented. As a result, a compact thin speaker, which realizes the high sound quality, can be provided.

Also, according to the present embodiment, the upper surface coil 12*a* is located inside of the inner circumference of the edge 11, and the lower surface coil 12*b* is located such that the outermost circumference thereof is situated outside of the inner circumference of the edge 11, whereby the adhesion failure between the diaphragm 10 and the edges 11 can be avoided, and also the deterioration in the sound quality caused by the primary resonance mode in the short side direction can be avoided. As a result, a further improvement in the sound quality is achievable.

Further, according to the present embodiment, the positions of the nodes of the primary resonance mode in the short direction is set as the center, and the long side portion of the upper surface coil 12*a* and the long side portion of the lower surface coil 12*b* are located in a misaligned manner in equal amounts, whereby the resultant force of driving forces generated in the upper surface coil 12*a* and the lower surface coil 12*b* can be maximized at the positions of the nodes of the primary resonance mode in the short side direction. As a result, the primary resonance mode in the short side direction can be suppressed efficiently.

Further, according to the present embodiment, the diaphragm, the edge, the voice coil, or the magnetic circuit are set such that the magnetic flux density reaches its maximum at the positions of the nodes of the primary resonance mode, whereby the driving force generated in the voice coil 12 can be maximized. As a result, the deterioration in the sound quality caused by the primary resonance mode is suppressed, and also a high efficiency speaker can be achieved.

Figure 12:
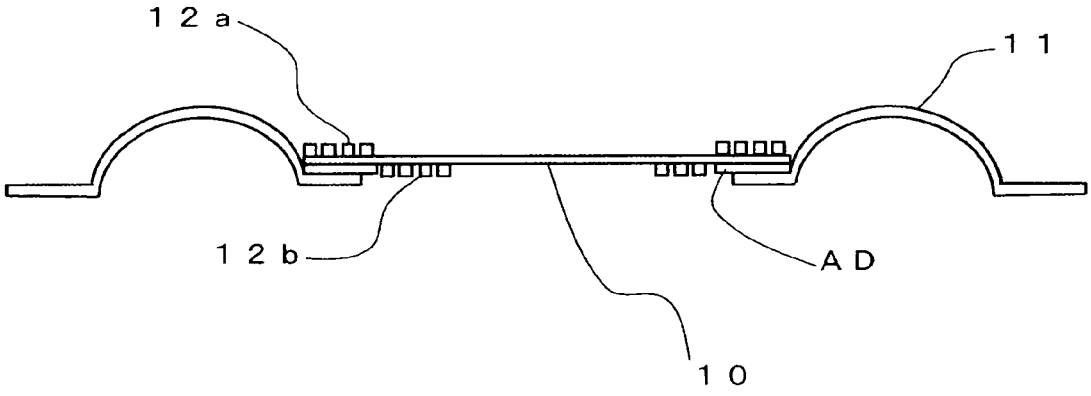
FIG. 12 is a diagram illustrating an example where an edge 11 adheres to the lower surface of the diaphragm 10.

Although the above description describes an example where the edge 11 is adhered on the upper surface of the diaphragm 10, as shown in FIG. 12, there may be a case where the edge 11 may be adhered on the lower surface of the diaphragm 10. FIG. 12 is a diagram illustrating an example where the edge 11 adheres to the lower surface of the diaphragm 10. In this case, since the edge 11 adheres to the lower surface of the diaphragm 10, the long side portion of the lower surface coil 12*b* is located inside of the inner circumference of the edge 11. The upper surface coil 12*a* is located such that an outermost circumference thereof is located outside of the inner circumference of the edge 11.

Further, according to the above description, the inner margin of the edge 11 is firmly fixed on the outer margin of the upper surface of the diaphragm 10 with the adhesive agent AD. Here, even in the case of fixation by any method other than the method using the adhesive agent AD, an adhesion failure will occur if the voice coil is located on the joint section of the edge 11 and the diaphragm 10. However, even in such a case, the speaker according to the present embodiment can prevent the adhesion failure.

Further, according to the above description, the long side portion of the voice coil 12 is located at the positions of the nodes of the primary resonance mode of the diaphragm 10 in the short side direction. Contrastingly, the short side portion of the voice coil 12 may be located at the positions of the nodes of the primary resonance mode of the diaphragm 10 in the long side direction. In this case, the short side portions of the upper surface coil 12*a* and the lower surface coil 12*b* can be located in a misaligned manner in a way similar to the long side portions as above described. That is, the all circumferences of the upper surface coil 12*a* may be located inside of the inner circumference of the edge 11, and the all circumferences of the lower surface coil 12*b* may be located such that the outermost circumference thereof is positioned outside of the inner circumference of the edge 11.

Figure 13:
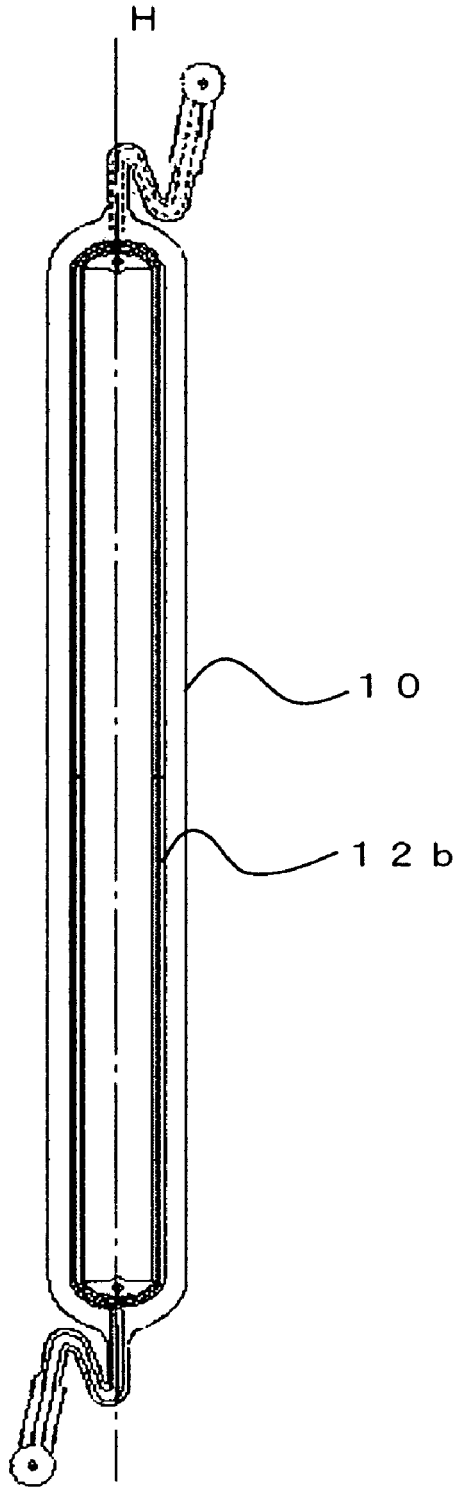
FIG. 13 is a diagram illustrating an example of a shape of the diaphragm 10 in the present embodiment.

A shape of the diaphragm 10 is not limited to a track shape. For example, the shape of the diaphragm 10 may be a circle, an ellipse, or a square. In the case of the circle, the node of the primary resonance mode tends to exist concentrically in the vicinity of the outer margin of the diaphragm 10. In the case of the ellipse, the node of the primary resonance mode tends to exist at a position very similar to that in the case of the above-described track-shape. Further, the shape of the diaphragm 10 may be, as shown in FIG. 13, a more elongated track shape than the track shape shown in FIG. 1. FIG. 13 is a diagram illustrating an example of a shape of the diaphragm 10 according to the present embodiment.

Figure 14:
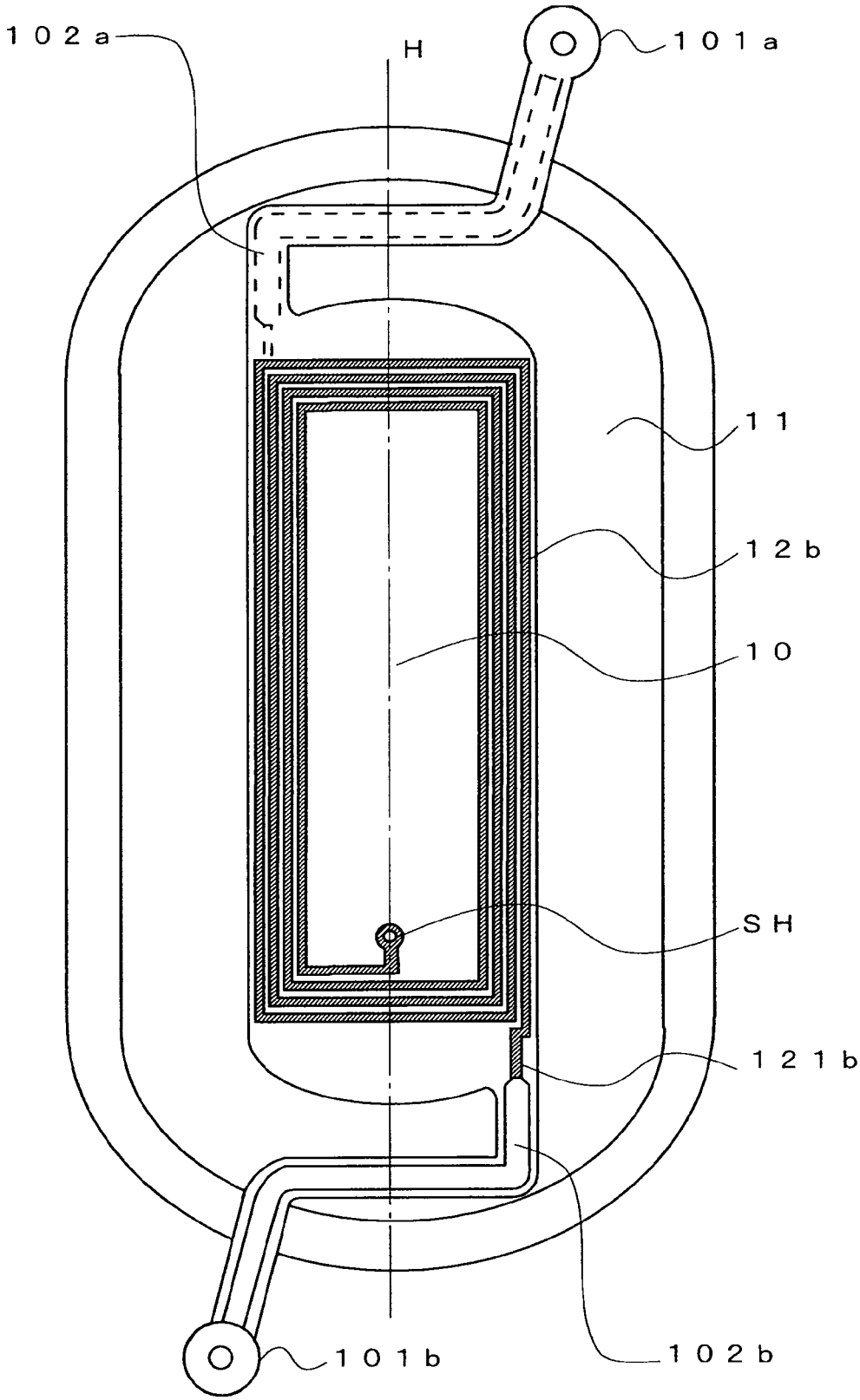
FIG. 14 is a diagram illustrating an example showing a difference in shapes of leading lines 102*a* and 102*b*.

Further, shapes of leading lines 102*a* and 102*b* are not limited to shapes shown in FIG. 3. The shapes of the leading lines 102*a* and 102*b* may be, for example, those shown in FIG. 14. FIG. 14 is a diagram illustrating an example showing a difference in the shapes of the leading lines 102*a* and 102*b*. Here, the longer distances from the diaphragm 10 to terminals 101*a* and 101*b* are, the more desirable the shapes of the leading lines 102*a* and 102*b* are. Further, it is desirable that the shapes of the leading lines 102*a* and 102*b* are symmetrical shapes with respect to a center of the diaphragm 10. It is also desirable that the leading lines 102*a* and 102*b* are located at symmetrical positions with respect to the center of the diaphragm 10. Accordingly, A stress concentration into the leading lines 102*a* and 102*b* can be avoided.

The shapes of the leading line 102*a* and 102*b* as shown in FIG. 3 are such shapes that satisfy the above conditions. Specifically, the shapes have such bending sections that invert once, at the position on the centerline H of the diaphragm 10, toward the diaphragm 10 side and come closer to the diaphragm 10. Further, the shape of the leading line 102*b* shown in FIG. 14 also satisfies the above conditions. The leading line 102*b* has such a shape that leads the lower surface coil 12*b* from a right extremity of the diaphragm 10 in the short side direction and connects the lower surface coil 12*b* to the terminal 101*b* located to the left of the center line H of the diaphragm 10. At this time, a lead portion 121*b* of the lower surface coil 12*b* is located at the right extremity of the diaphragm 10 in the short side direction. On the other hand, the leading line 102*a* has such a shape that leads the upper surface coil 12*a* from a left extremity of the diaphragm 10 in the short side direction and connects the upper surface coil 12*a* to the terminal 101*a* located to the right of the centerline H of the diaphragm 10.

As above described, the shapes of the leading lines 102*a* and 102*b* shown in FIG. 14 are such that distances from the diaphragm 10 side to the respective terminals 101*a* and 101*b* are long. Further, The shapes thereof are symmetrical with respect to the center of the diaphragm 10. The shapes of the leading line 102*a* and 102*b* are not limited to the shapes shown in FIGS. 3 and 14. As long as the above conditions are satisfied, any shapes may be acceptable.

Second Embodiment

Figure 15:
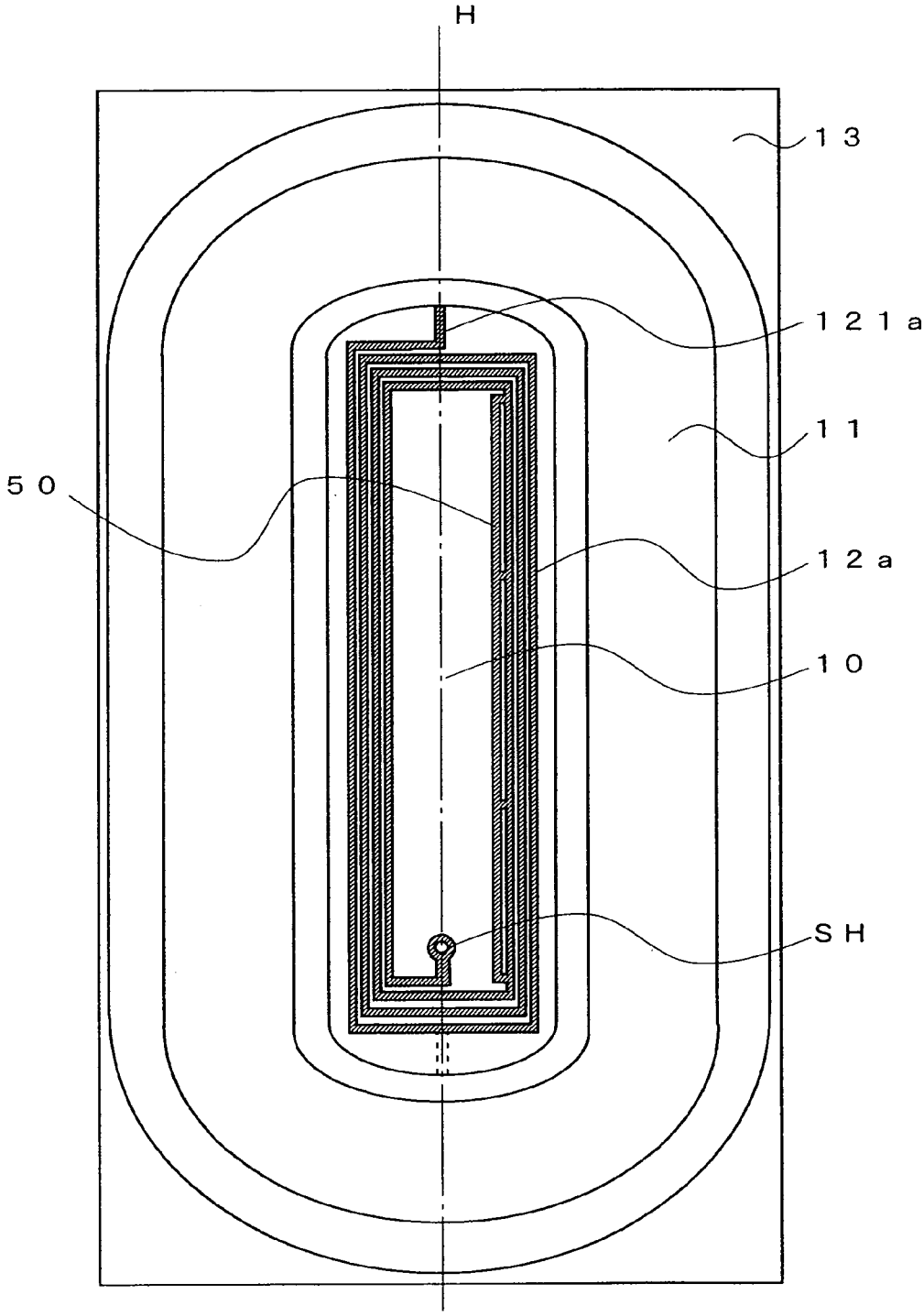
FIG. 15 is a plan view of a speaker according to a second embodiment.
Figure 16:
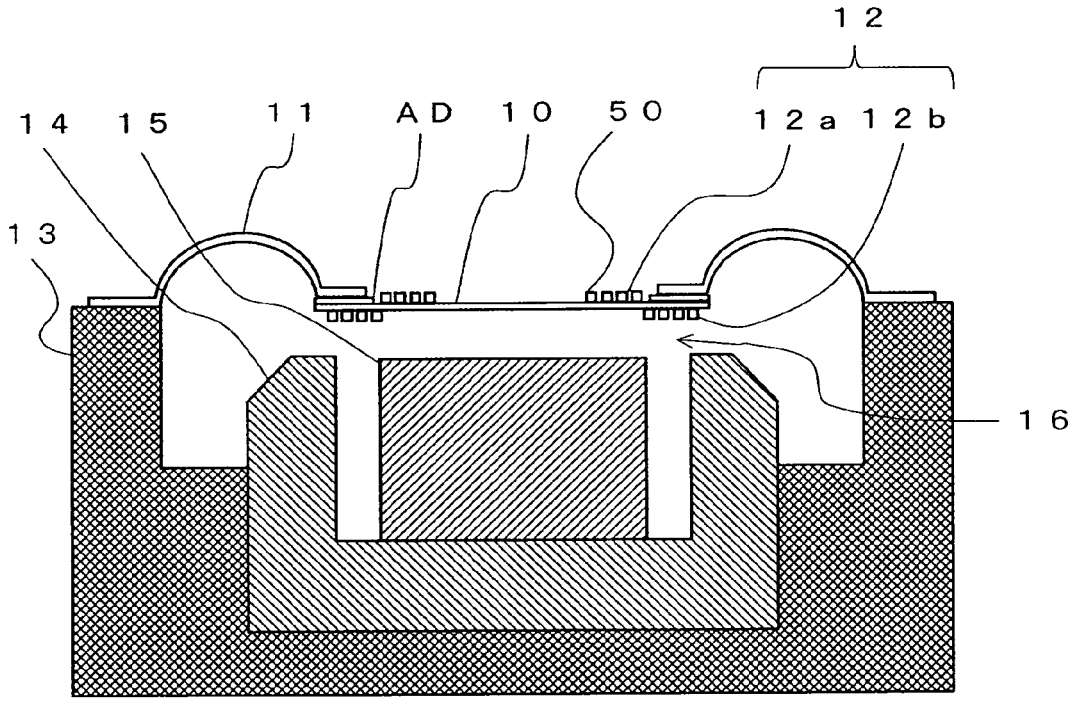
FIG. 16 is across-sectional view of the speaker, in a short side direction, shown in FIG. 15.

Hereinafter, a speaker according to a second embodiment of the present invention will be described referring to FIGS. 15 and 16. FIG. 15 is a plan view of the speaker according to the second embodiment. FIG. 16 is a cross sectional view of the speaker, in the short side direction, shown in FIG. 15. The speaker according to the second embodiment is a speaker in which an additional wiring 50 is added on a diaphragm 10 in comparison to the above-described speaker according to the first embodiment, and a weight balance of the diaphragm 10 is improved. Further, each component section, other than the additional wiring 50, according to the present embodiment has the same constitution as each component section of the above-described first embodiment has, and thus with the use of the same reference characters, descriptions thereof are omitted.

With regard to the speaker according to the above-described first embodiment, the leading lines 102*a* and 102*b* are located symmetrically with respect to the center of the diaphragm 10. Further, the pattern is formed such that the upper surface coil 12*a* and the lower surface coil 12*b* do not intersect with each other except at the through hole SH. That is, the pattern is formed so that the winding direction of the upper surface coil 12*a* will be the same direction as that of the lower surface coil 12*b* when looked from the upper surface side (or lower surface side) of the diaphragm 10. Under these conditions, either of the upper surface coil 12*a* or the lower surface coil 12*b* is missing half a turn in length. With reference to the upper surface coil 12*a* in FIG. 1, a number of wirings on the left of the centerline H of the diaphragm 10 is four, where as, a number of wirings on the right is three. Hence, in the short side direction of the diaphragm 10, a weight of the diaphragm 10 is off-balance to the extent of the number of wirings of one. Therefore, in the present embodiment, the additional wiring 50 is added, and an improvement in a weight balance of the diaphragm 10 is considered. Accordingly, an asymmetrical vibration arising from the weight balance of the diaphragm 10 can be suppressed, and an occurrence of a distortion caused by the asymmetrical vibration can be suppressed.

As shown in FIGS. 15 and 16, the additional wiring 50 is, on the right of a centerline H, connected in parallel to a long side portion of an innermost circumference of an upper surface coil 12*a*. The additional wiring 50 is such a wiring that is the same as the long side portion of the upper surface coil 12*a* in length, in thickness and in width. Further, the additional wiring 50 is located such that the long side portion of the upper surface coil 12*a* will be of a bilaterally symmetrical shape, with respect to the centerline H of the diaphragm 10. Referring to FIG. 16, cross-sectional shapes of the long side portion of the upper surface coil 12*a* is of a bilaterally symmetrical shape with respect to a center of the diaphragm 10. Accordingly, a gravity center of the long side portion of the upper surface coil 12*a* in coincides with the center of the diaphragm 10, and consequently the weight balance will improve.

Figure 17:
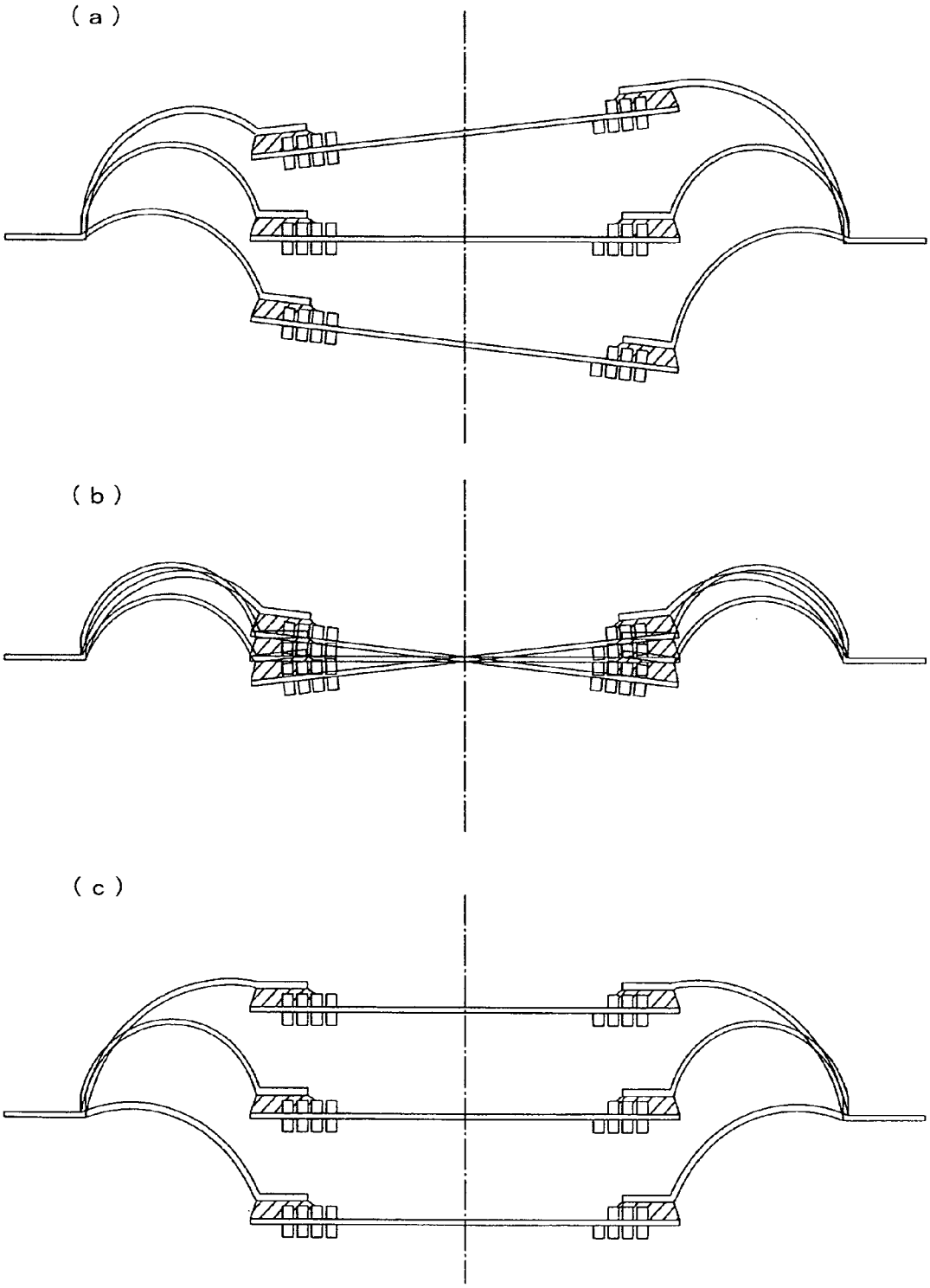
FIG. 17 is a diagram illustrating a manner of vibration of the diaphragm 10 in the short side direction.

Here, referring to FIG. 17, a state of the diaphragm 10, which is vibrating asymmetrically, is analyzed. FIG. 17 is a diagram illustrating a manner of vibration of the diaphragm 10 in the short side direction. The state shown in FIG. 17 is calculated based on a finite element method. FIG. 17(*a*) shows the manner of the vibration of the diaphragm 10. When the vibration shown in FIG. 17(*a*) is broken down into a rotational vibration and a translational vibration, the manners of vibration are as shown in (b) and (c) of FIG. 17. FIG. 17(*b*) is a diagram illustrating the rotational vibration. FIG. 17(*c*) is a diagram illustrating the translational vibration. The rotational vibration shown in FIG. 17(*b*) is a source of distortion.

Figure 18:
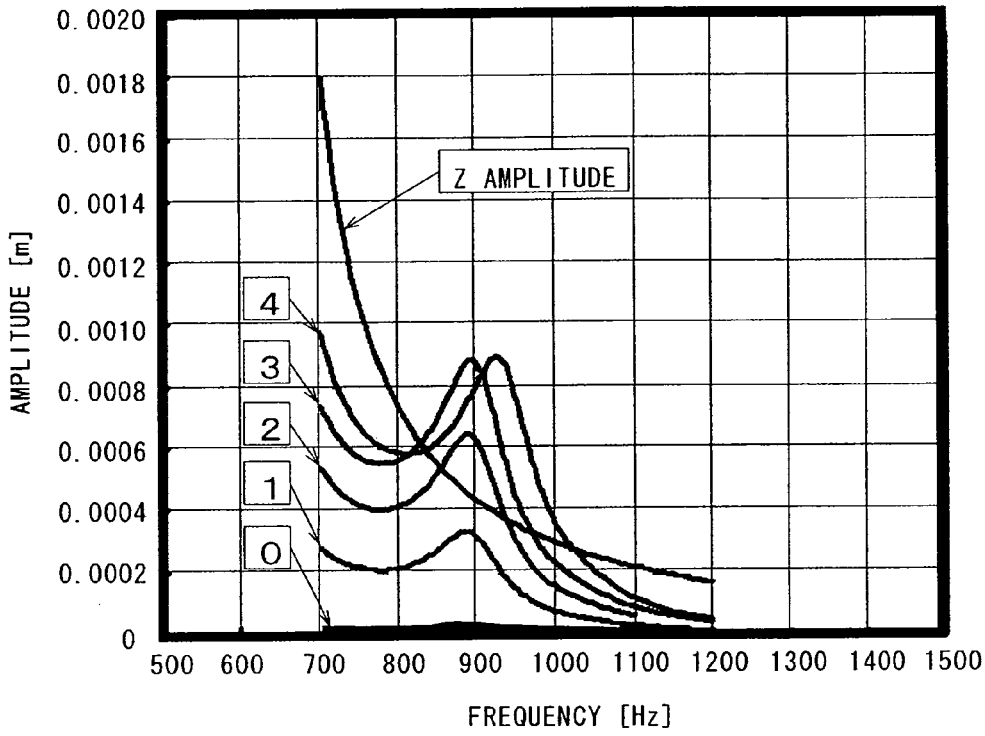
FIG. 18 is a diagram illustrating a relation between numbers of wirings on right and left of the upper surface coil 12*a* and an amplitude amount of a rotational vibration.

Further, a change of the rotational vibration shown in FIG. 17(*b*), depending on the weight balance of the upper surface coil 12*a*, will be described, with reference to FIG. 18. FIG. 18 is a diagram illustrating a relation between numbers of wirings on the right and left of the upper surface coil 12*a* and an amplitude amount of the rotational vibration. In FIG. 18, a horizontal axis indicates a frequency, and a vertical axis indicates an absolute value of the amplitude amount. Further, Z amplitude shown in FIG. 18 indicates an amplitude amount of the translational vibration. The other curves indicate the amplitude amounts of the rotational vibrations. Note that a number (4, 3, 2, 1 and 0) added to each curve indicates a number of missing wirings on the upper surface coil 12*a*. That is, the curve 4 indicates the amplitude amount of the rotational vibration in a case where the number of wirings on the left is four, and the number of wirings on the right is zero with four wirings missing, on the upper coil 12*a* in the long side direction. In a similar way, the curve 3 indicates the amplitude amount of the rotational vibration for the case where the number of missing wirings on the right is three. The curve 2 indicates the amplitude amount of the rotational vibration for the case where the number of the missing wirings on the right is two. The curve 1 indicates the amplitude amount of the rotational vibration for the case where the number of the missing wirings on the right is one. The curve 0 indicates the amplitude amount of the rotational vibration in the case where the numbers of wirings on the right and left are equal. Further, each of the curves 0 to 4 indicates the rotational vibration when the translational vibration is at the amplitude amount of Z amplitude. That is, the curves 0 to 4 are such curves that show comparisons of the respective amplitude amounts of the rotational vibrations at identical inputs, with Z amplitude set as an input standard. Further, each of the curves 2 to 4 is not a calculation result based on those actually coil-formed, but the calculation result based on consideration of the weight balance only.

According to an analysis result of FIG. 18, it is clear that the amplitude amount of the curve 4 is generally larger compared to the other curves. And it is clear that as the curve changes from 4 to 0, the amplitude amount of the rotational vibration is getting smaller. As above described, the smaller the missing number is, the smaller the amplitude amount of the rotational vibration becomes. That is, the smaller the missing number is, the closer the gravity center of the long side portion of the upper surface coil 12*a* comes to the center of the diaphragm 10, and thus the more the weight balance of the long side portion of the upper surface coil 12*a* improves. Due to an improvement in the weight balance, the amplitude amount of the rotational vibration becomes smaller, and then the occurrence of distortion arising from the rotational vibration can be suppressed.

As above described, a weight such as the additional wiring 50 is added to the diaphragm 10, whereby the weight balance of diaphragm 10 as a whole including the voice coil 12 improves. Accordingly, an occurrence of the asymmetrical vibration in the short side direction is suppressed, and an occurrence of an abnormal sound and the distortion can be avoided. As a result, in comparison to the above-described first embodiment, a further improvement in the sound quality can be achieved.

Figure 19:
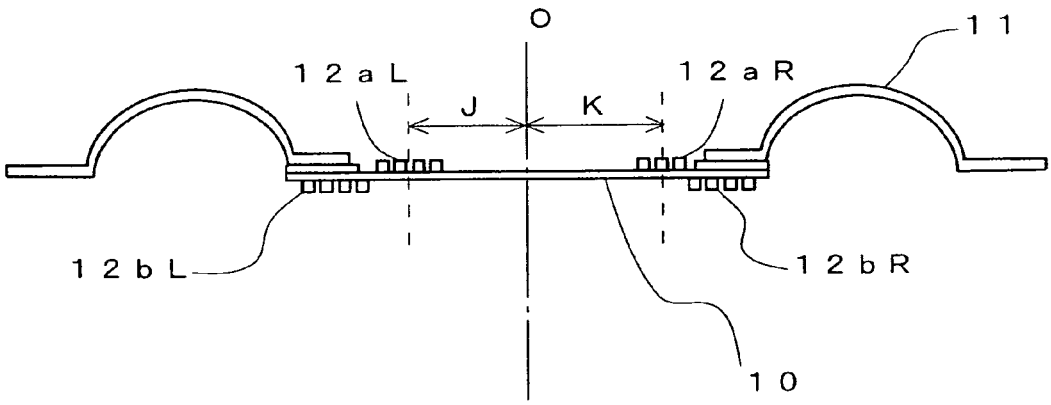
FIG. 19 is a diagram illustrating an example where the upper surface coil 12*a* and the lower surface coil 12*b* are located such that the respective gravity centers thereof are positioned on a central axis O.

In the above description, the additional wiring 50 and the long side portion of the innermost circumference of the upper surface coil 12*a* are connected in parallel to each other, but may be in a separated state. Further, as shown in FIG. 19, so as to have each of the gravity centers of the upper surface coil 12*a* and a lower surface coil 12*b* located on the central axis O in the cross-section of the diaphragm 10, the locations of the upper surface coil 12*a* and the lower surface coil 12*b* may be considered. FIG. 19 is a diagram illustrating an example where the upper surface coil 12*b* and the lower surface coil 12*b* are located such that the respective gravity centers thereof are positioned on the central axis O. Here, for a specific description, a right long side portion of the upper surface coil 12*a* is referred to as a long side portion 12*a*R. A left long side portion of the upper surface coil 12*a* is referred to as a long side portion 12*a*L. Further, a right long side portion of the lower surface coil 12*b* is referred to as a long side portion 12*b*R. A left long side portion of the lower surface coil 12*b* is referred to as a long side portion 12*b*L. As shown in FIG. 19, the long side portion 12*a*R has the number of wirings of three. On the other hand, the long side portion 12*a*L has the number of wirings of four. Further, the long side portions 12*b*R and 12*b*L respectively have the number of wirings of four. Therefore, with regard to the lower surface coil 12*b*, each of the long side portions 12*b*R and 12*b*L is equal in weight, and is located in a position at a equal distance from the central axis O, and as a result, the gravities center thereof are located on the central axis O.

On the other hand, with regard to the upper surface coil 12*a*, the respective long side portions 12*a*R and 12*a*L are different in weight. In this case, each of distances from the respective long side portions 12*b*R and 12*b*L to the central axis O is adjusted, whereby the gravity center of the upper surface coil 12*a* can be located on the central axis O. Specifically, a locating at a position that satisfies the following relational expression is acceptable.

(Weight of long side portion 12*aL*)*(Distance *J* toward central axis *O*)=(Weight of long side portion 12*aR*)*(Distance *K* toward central axis *O*)

As above described, each gravity center of the upper surface coil 12*a* and the lower surface coil 12*b* is located at a position on the central axis O in the cross-section of the diaphragm 10, whereby the weight balance of the whole diaphragm 10 improves, and the occurrence of the abnormal sound and the distortion can be avoided.

Further, in the above description, although the weight balance of the diaphragm 10 in the short side direction is described, the weight balance of the diaphragm 10 in the long side direction may also be improved. Further, with an addition of a weight such as a dummy pattern to a position different from that of the additional wiring 50, the weight balance may be improved. Further, with an addition of the weight with an application of an adhesive agent mainly comprising rubber and epoxy, the weight balance may be improved.

Further, the diaphragm 10 and the edge 11 may be of an integral structure in the present embodiment. Further, a shape of the diaphragm 10 may be, in a way similar to the above-described first embodiment, a circle, an ellipse, or a square.

The speakers according to the above-described first and second embodiments are compact thin speakers which realizes the high sound quality, and are useful for installation to electronics device such as visual equipment including PDP, and liquid crystal television, etc., information and communication equipment including a cellular phone, and PDA, etc., and a game machine. Further, installation to the electronics device fixed to an automobile is also useful.

Figure 20:
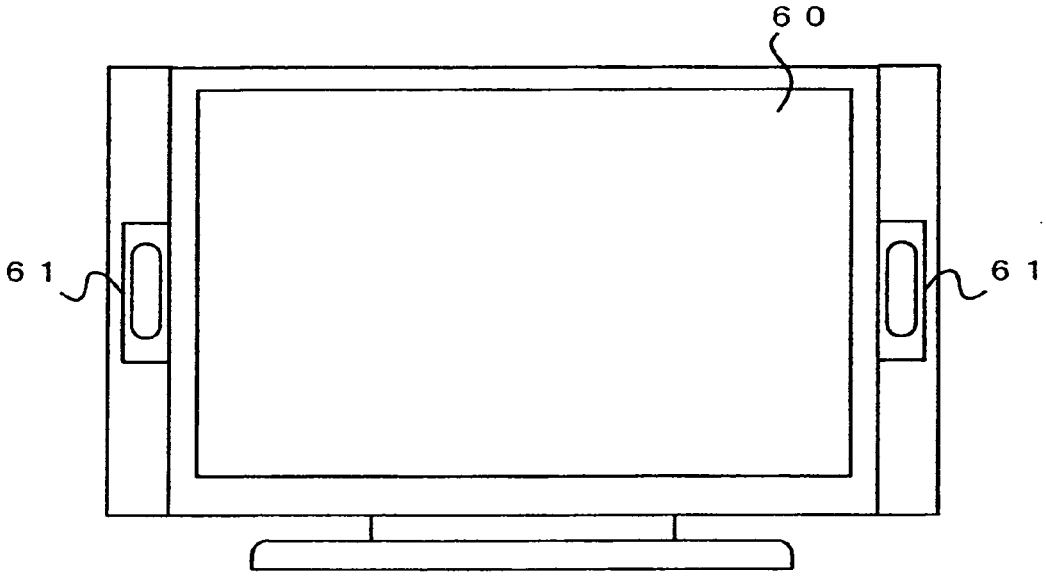
FIG. 20 is a diagram illustrating a constructional example of a case where a speaker 61 is installed in an inside housing of PDP.
Figure 21:
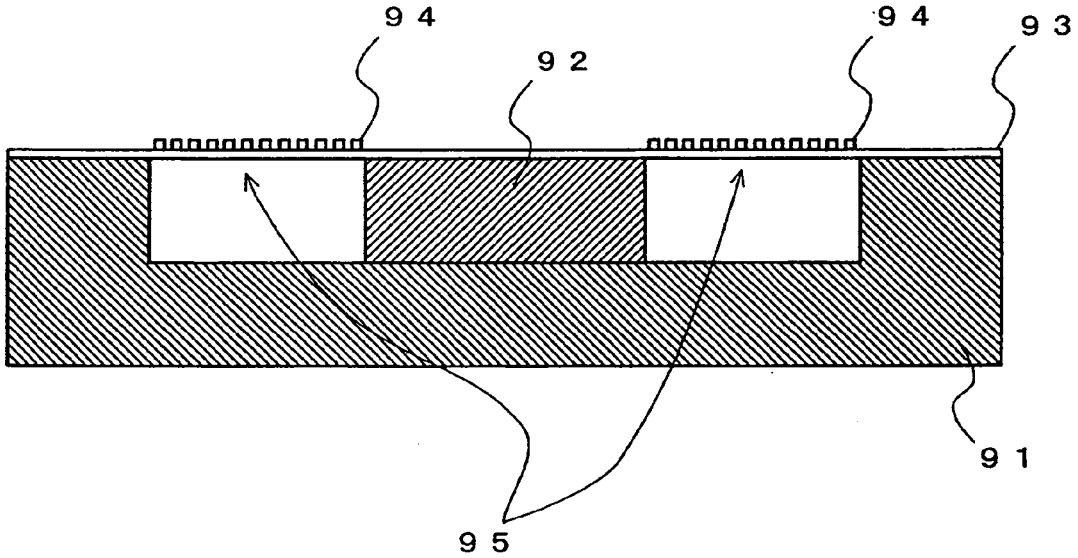
FIG. 21 PRIOR ART
FIG. 21 is a cross sectional view of a conventional speaker.

Hereinafter, referring to FIG. 20, a case where a speaker 61 is installed in an inside housing of a PDP will be described. FIG. 20 is a diagram illustrating a constructional example of a case where the speaker 61 is installed in the inside housing of the PDP. The speaker 61 is either of the speakers according to the above-described first or second embodiment. According to the FIG. 20, the speaker 61 is fixed on both right and left sides of a display screen 60. In this way, the speaker 61 is installed in the PDP, whereby a horizontal width of the whole PDP can be narrowed down, and a high quality sound can be provided to a user. In FIG. 20, each of the right and left speakers 61 is located at a position which is on the same height as a center of the display screen 60 is. Therefore, a sound image is localized at the center of the display screen 60 by the right and the left speakers 61, and thus sound with a high realistic sensation can be provided to the user.

INDUSTRIAL APPLICABILITY

The speaker according to the present invention is useful for installation to visual equipment, information and communication equipment, and an electronics device such as a game machine, and further an electronics device fixed to an automobile, all of which are capable of mounting a compact thin speaker with high sound quality.

The invention claimed is:

1. A speaker, comprising:

a magnetic circuit;

a diaphragm, a part of which is located in a magnetic gap formed in the magnetic circuit;

a ring-shaped first voice coil formed on a first vibrating surface of the diaphragm;

a ring-shaped second voice coil which is formed on a second vibrating surface of the diaphragm, the second vibrating surface being an opposite surface to the first vibrating surface, and which is electrically conducted with the first voice coil; and an edge firmly fixed on an outer margin of the first vibrating surface and operable to support the diaphragm in such a manner that enables vibration, wherein the first voice coil is formed so as to be located inside of an inner circumference of the edge and also within the magnetic gap, and the second voice coil is formed so as to have at least a part of an outermost circumference thereof located outside of the inner circumference of the edge and also within the magnetic gap.

2. The speaker according to claim 1, wherein a node of a primary resonance mode of the diaphragm exists between an innermost circumference of the first voice coil and the outermost circumference of the second voice coil.

3. The speaker according to claim 2, wherein a distance from a position of the node of the primary resonance mode to the innermost circumference of the first voice coil is same as the distance from the position of the node of the primary resonance mode to the outermost circumference of the second voice coil.

4. The speaker according to claim 2, wherein the magnetic circuit comprises a pillar-shaped magnet situated at a position facing the second vibrating surface, and an extremity of a surface of the magnet, the surface facing the second vibrating surface, coincides with the position of the node of the primary resonance mode.

5. The speaker according to claim 2, wherein the magnetic circuit comprises:

a first pillar-shaped magnet located at a position facing the first vibrating surface; and a second pillar-shaped magnet located at a position facing the second vibrating surface, and the node of the primary resonance mode exists on a straight line connecting, by a most direct way, an extremity of a surface of the first magnet, the surface facing the first vibrating surface, with an extremity of a surface of the second magnet, the surface facing the second vibrating surface.

6. The speaker according to claim 1, further comprising:

a first leading line to input a driving current to the first voice coil; and a second leading line to input the driving current to the second voice coil, wherein the first and the second leading lines are located so as to be symmetrical with respect to a center of the diaphragm, a winding direction of the first voice coil is a same direction as the winding direction of the second voice coil with respect to the first vibrating surface, and a position of a gravity center of each of the first and second voice coils coincides with the center of the diaphragm.

7. The speaker according to claim 6, further comprising a weight added to the diaphragm such that the position of the gravity center of each of the first and the second voice coils coincides with the center of the diaphragm.

8. The speaker according to claim 7, wherein the weight, having a same shape as a wiring constituting each of the first and the second voice coils has, is added so as to be aligned along the wiring of either of the first or the second voice coil.

9. The speaker according to claim 1, wherein the diaphragm has an elongated shape, the first and the second voice coils have shapes, which are formed on the diaphragm, of elongated shapes including a long side portion which is aligned along a long side direction of the diaphragm, and the second voice coil is formed such that at least the outermost circumference of the long side portion thereof is located outside of the inner circumference of the edge and within the magnetic gap.

10. The speaker according to claim 9, wherein the node of the primary resonance mode in a short side direction of the diaphragm exists between an innermost circumference of the long side portion of the first voice coil and the outermost circumference of the long side portion of the second voice coil.

11. The speaker according to claim 10, wherein a distance from a position of the node of the primary resonance mode in the short side direction to the innermost circumference of the long side portion of the first voice coil is same as the distance from the position of the node of the primary resonance mode to the outermost circumference of the long side portion of the second voice coil.

12. The speaker according to claim 10, wherein the magnetic circuit comprises a pillar-shaped magnet being located at a position facing the second vibrating surface, and in the short side direction of the diaphragm, an extremity of a surface of the magnet, the surface facing the second vibrating surface, coincides with the position of the node of the primary resonance mode in the short side direction.

13. The speaker according to claim 10, wherein the magnetic circuit comprises:

a pillar-shaped first magnet located at a position facing the first vibrating surface; and a pillar-shaped second magnet located at a position facing the second vibrating surface, and in the short side direction of the diaphragm, the node of the primary resonance mode in the short direction exists on a straight line connecting, by a most direct way, an extremity of a surface of the first magnet, the surface facing the first vibrating surface, with an extremity of a surface of the second magnet, the surface facing the second vibrating surface.

14. The speaker according to claim 9, further comprising:

a first leading line to input a driving current to the first voice coil; and a second leading line to input the driving current to the second voice coil, wherein the first and the second leading lines are located so as to be symmetrical with respect to a center of the diaphragm, a winding direction of the first voice coil is a same direction as the winding direction of the second voice coil with respect to the first vibrating surface, and a position of a gravity center of each of the long side portions of the first and the second voice coils coincide with the center of the diaphragm.

15. The speaker according to claim 14, further comprising a weight added to the diaphragm such that the position of the gravity center of each of the long side portions of the first and the second voice coils coincides with the center of the diaphragm.

16. The speaker according to claim 15, wherein the weight, having a same shape as a wiring constituting each of the first and the second voice coils, is added so as to be aligned along the long side portion of either of the first or the second voice coil.

17. The speaker according to claim 1, wherein an outermost circumference of the first voice coil is located outside of an innermost circumference of the second voice coil.

18. The speaker according to claim 1, wherein the outermost circumference of the first voice coil adjoins the inner circumference of the edge.

19. The speaker according to claim 1, wherein a shape of the edge is a roll shape.

20. An electronics device comprising:

the speaker according to claim 1; and a housing for accommodating the speaker.

* * * * *